United States Patent [19]

Kameyama et al.

[11] Patent Number: 5,037,151

[45] Date of Patent: Aug. 6, 1991

[54] LIFTING SLING

[75] Inventors: Kazuhide Kameyama, Kawachinagano; Yosinobu Chaen, Sakai; Takeo Nakamura, Fukuoka; Kazunori Nagata, Kitakyushu, all of Japan

[73] Assignee: Sankyu Inc., Kitakyushu, Japan

[21] Appl. No.: 470,829

[22] Filed: Jan. 26, 1990

[30] Foreign Application Priority Data

| | | | |
|---|---|---|---|
| Jan. 28, 1989 | [JP] | Japan | 1-9067[U] |
| May 25, 1989 | [JP] | Japan | 1-61266[U] |
| May 25, 1989 | [JP] | Japan | 1-61267[U] |

[51] Int. Cl.[5] ..... B66C 1/12; B66C 1/28

[52] U.S. Cl. ..... 294/81.55; 294/81.56; 294/81.61

[58] Field of Search ..... 294/81.55, 81.2, 81.5, 294/81.51, 81.56, 81.61, 74, 106, 82.1, 82.13

[56] References Cited

U.S. PATENT DOCUMENTS

| | | | |
|---|---|---|---|
| 2,603,523 | 7/1952 | Cameron | 294/81.55 X |
| 4,293,155 | 10/1981 | Grant | 294/81.56 X |
| 4,736,976 | 4/1988 | Berzenye | 294/81.56 X |

FOREIGN PATENT DOCUMENTS

| | | | |
|---|---|---|---|
| 5147219 | 2/1974 | Japan . | |
| 52-133653 | 11/1977 | Japan . | |
| 56-124678 | 9/1981 | Japan . | |
| 62-186880 | 11/1987 | Japan . | |
| 486995 | 1/1975 | U.S.S.R. | 294/81.55 |
| 500158 | 1/1976 | U.S.S.R. | 294/81.55 |
| 600070 | 3/1978 | U.S.S.R. | 294/81.55 |

*Primary Examiner*—Margaret A. Focarino
*Assistant Examiner*—Dean J. Kramer
*Attorney, Agent, or Firm*—Hoffman & Baron

[57] ABSTRACT

In a lifting sling for lifting up at least one elongated article, a pair of wire rope units depend respectively from a pair of hooking units which are arranged respectively at opposite ends of the elongated article. A pair of guide arm units each having one end pivotally attached to the elongated beam respectively adjacent to the opposite ends thereof accommodate and support respectively the pair of wire rope units. A pair of actuator units each has one end pivotally attached to the elongated beam and the other end pivotally attached respectively to the pair of guide arm units. The pair of actuator units respectively move the pair of guide arm units toward and away from each other about their corresponding ends. A controller is connected to the pair of actuator units for operating the same to move the pair of guide arm units toward and away from each other.

41 Claims, 17 Drawing Sheets

LIFTING SLING

BACKGROUND OF THE INVENTION

The present invention relates to lifting slings for lifting up a plurality of elongated heavy articles such as products, components, devices, mechanical elements or members, structural materials and particularly pipes, rolls, slabs or the like, to carry the elongated articles to desirable locations and, more particularly, to a lifting sling for lifting up at least one elongated article without the need of assistance of a third person such as a slinging worker or the like. The pipes may be made of metal, plastics or concrete used in various industries, and may be made of steel having particularly high rigidity.

As is generally known, the following means is adopted or taken in cases where various cranes are used to carry loads. That is, normally, a pair of wire rope units are arranged in agreement with a load manually. Then, a pair of hanging rings arranged respectively at proximal ends of the wire rope units are hung on a hook of a crane, to lift up the load.

Incidentally, for the purposes of saving energy or power, increasing the efficiency of the work and increasing safety, a lifting sling for at least one elongated article has been proposed which involves only an operator of the crane and remote-controls of operation of engagement and disengagement of the wire rope units with respect to the load, that is, so-called slinging work.

For instance, a lifting sling for lifting up an elongated heavy article such as a rolling roll or the like is disclosed in Japanese Utility Model Unexamined Publication No. 56-124678. The lifting sling comprises a hoisting element which is detachably suspended from a crane hook. A guiding rod is mounted on the hoisting element and has an end at which a stopper is arranged. A sliding element is loosely fitted about the guide rod movable vertically. A pair of arm elements are pivotally attached to the sliding element. A pair of wire elements are connected between forward ends of the respective arm elements and the hoisting element. A pair of hanging wire elements depend respectively from the forward ends of the arm elements.

The above lifting sling is capable of transporting loads to be carried extremely efficiently, if the loads are specified, and if dimensions and weights of the loads are determined. If the loads are different in dimension from each other and different in weight from each other, however, it is difficult to cope with such loads. In view of this, the inventors of this application have developed a lifting sling which has a wide range of utilization and which is efficient. The inventors have filed an application relating to the lifting sling.

The above-mentioned application has been laid open to public inspection as Japanese Utility Model Unexamined Publication No. 62-186880. A lifting sling disclosed in the Japanese unexamined publication comprises a pair of wire rope units which are detachably suspended from a crane hook. A support rod element is detachably suspended from the crane hook through an attaching element which is mounted on the top of the support rod element. A pair of sliding support arms in the form of a wing are pivotally supported by the support rod element. A pair of operational cylinders are provided which extend between the support rod element and the pair of sliding support arms. An opening guide device is provided which includes a mechanism having a pair of link elements for enabling the pair of sliding support arms to be opened and closed in a symmetrical manner. A remote-controller operates the pair of operational cylinders so as to extend and contract rods of the respective cylinders. The pair of sliding support arms guide the pair of wire rope units so as to be capable of being opened and closed by means of the opening guide device and the remote-controller. Accordingly with the lifting sling, it is possible to remote-control the lifting sling without the necessity of a slinging worker.

The above lifting sling will be described below in detail with reference to FIGS. 25 and 26 of the attached drawings. A pair of detachable wire rope straps 2*a* and 2*b* are suspended from a T-shaped crane hook 1. The pair of wire rope straps 2*a* and 2*b* are guided by a pair of sliding support arms 3*a* and 3*b* arranged in the form of a wing and an opening guide device R subsequently to be described, such that the pair of wire rope straps 2*a* and 2*b* are arranged symmetrically to each other and their opening angle is adjustable.

Without assistance of a slinging worker, an operator of a crane (not shown) hangs lower ends $2a_1$ and $2b_1$ of the respective wire rope straps 2*a* and 2*b* around both ends of an elongated article to be carried, for example, around both ends 4*a* and 4*b* of a rolling roll 4. Then, the operator lifts up the rolling roll 4 and carries the same to a desirable location. Subsequently, the operator lowers the rolling roll 4 at the desirable location, and operates the opening guide device R. The pair of sliding support arms 3*a* and 3*b* in the form of a wing are moved away from each other. The lower ends $2a_1$ and $2b_1$ of the respective wire rope straps 2*a* and 2*b* are disengaged respectively from both ends 4*a* and 4*b* of the rolling roll 4. The operator can then immediately begin the subsequent carrying operation.

The pair of wire rope straps 2*a* and 2*b* are in slidable engagement with the pair of sliding support arms 3*a* and 3*b*, respectively. Accordingly, no unreasonable force is applied to the pair of sliding support arms 3*a* and 3*b* and the opening guide device R. In addition, it is possible to cope with elongated articles to be carried having various dimensions or sizes within a permissible or allowable range of opening angle of the pair of sliding support arms 3*a* and 3*b*, without assistance of the slinging worker as described above.

Further, as shown in FIGS. 25 and 26, a top of a support rod element 5 is provided with an attaching element 6 which is detachably suspended from the crane hook 1. The pair of sliding support arms 3*a* and 3*b* are arranged in the form of a wing. Each of the arms 3*a* has an end which is pivotally or angularly movably supported by the support rod element 5 through one of a pair of support pivots 7*a* and 7*b*.

Since the other ends of the respective sliding support arms 3*a* and 3*b* are not restricted or restrained, the pair of sliding support arms 3*a* and 3*b* can be moved about the support pivots 7*a* and 7*b*, respectively like a wing. Moreover, the pair of sliding support arms 3*a* and 3*b* guide the pair of wire rope straps 2*a* and 2*b*, respectively. However, the pair of sliding support arms 3*a* and 3*b* are not in an engaging relationship to the pair of wire rope straps 2*a* and 2*b* such that they are restricted in movement relative to each other. Thus, members or elements designated respectively by the reference numerals 3*a* and 3*b* are called sliding support arms in the form of a wing.

A pair of operational cylinders 8*a* and 8*b* are pivotally attached to the bottom of the support rod element 5 and the respective sliding support arms 3*a* and 3*b*. A joint 10 is loosely fitted in a guide groove 9 which is formed in a lower portion of the support rod element 5. A pair of link plates 11*a* and 11*b* have one of their ends pivotally connected to upper portions of the pair of sliding support arms 3*a* and 3*b*, respectively. The other ends of the respective link plates 11*a* and 11*b* are pivotally connected to the joint 10 which is movable along the guide groove 9.

When the pair of operational cylinders 8*a* and 8*b* are operated, the pair of sliding support arms 3*a* and 3*b* can be moved toward and away from each other symmetrically about the longitudinal axis of the support rod element 5 due to cooperation between the joint 10 and the guide groove 9 such that the angle between the pair of operational cylinders 8*a* and 8*b* is adjustable. This angular movement of the pair of sliding support arms 3*a* and 3*b* is called the capability of opening angle. A mechanism composed of the pair of operational cylinders 8*a* and 8*b* and the pair of link plates 11*a* and 11*b* is called the opening guiding device R which enables the pair of sliding support arms 3*a* and 3*b* to be opened and closed in symmetrical relation to each other.

As illustrated in FIG. 25, an air line 12 is connected to the pair of operational cylinders 8*a* and 8*b* (in this example, air cylinders) to supply air thereto. The air line 12 is connected to a remote-controller (not shown) which is arranged within a crane operation room. Of course the pair of operational cylinders 8*a* and 8*b* may utilize any suitable power sources such as a hydraulic source or an electric source, instead of the pneumatic source. The remote-controller is well-known, and the description thereof will be omitted.

Furthermore, two pairs of guide connecting plates 13 and 14 are provided respectively for the pair of sliding support arms 3*a* and 3*b*. A pair of slip off preventing hook units 15 and 15 are also provided respectively for the pair of sliding support arms 3*a* and 3*b*. Each of the pair of slip off preventing hook units 15 and 15 is composed of a pair of hooks, as shown in FIG. 26.

As described above, in the lifting sling constructed as mentioned previously, loads are applied only to the pair of wire rope straps 2*a* and 2*b*, but no loads are applied to the pair of sliding support arms 3*a* and 3*b* and the opening guide device R. Accordingly, it is unnecessary to use members or elements which are high in strength. Thus, the lifting sling can be designed economically. In addition, the lifting sling is easy in handling as compared with a conventional one. Replacement of the pair of wire rope straps 2*a* and 2*b* with respect to the crane hook 1 is also easy and simple and is high in operability. However, the inventors of this application have applied the above lifting sling to the lifting of various elongated articles to be carried, and have experienced that the following tasks are necessary.

That is, in the case of elongated heavy articles such as pipes or slabs having their lengths of 7 m to 15 m, two crane hooks are required, and two lifting slings cooperating together are used to lift up the elongated articles. Thus, the operation is difficult, and the posture of the elongated article or load becomes unstable. Moreover, in an aspect of the installation, the lifting sling is high in cost.

Apart from the above, in various industries, many elongated pipes made of various materials and in various forms are used for various purposes such as structural elements and transportation of various gasses and liquids. There are many cases where large cranes are utilized in manufacturing and processing of pipes, and mounting, transportation, storage and so on of the pipes. In this case, various pipe lifting slings have been developed in order to provide safety of operation and to improve the efficiency thereof.

For instance, a lifting sling is disclosed in Japanese Patent Publication No. 51-47219, in which, when pipes are suspended by hooking ropes having their hooks hung from a beam hook, the pipes are automatically disengaged from the hooking ropes by an arm expansion device. Further, Japanese Patent Unexamined Publication No. 52-133653 discloses a lifting sling in which a mobile hook vehicle is mounted on a hanging beam to automatically perform slinging work of pipes.

The inventors of this application have conducted working in which an overhead travailing crane is used to carry or transport various pipes, particularly, elongated steel pipes having a large internal diameter. The inventors have known or found that the conventional lifting slings have no devices or instruments which are adequate for efficient and safe transportation of many pipes.

For example, the lifting sling disclosed in the aforesaid Japanese Patent Publication No. 51-47219 is efficient for slinging of two or three pipes having relatively small open diameters. When many pipes having large internal diameters are transported, however, the lifting sling is complicated in structure and, simultaneously, operation of the lifting sling is also made difficult.

Further, the lifting sling disclosed in the above Japanese Patent Unexamined Publication No. 52-133653 is capable of automatically slinging pipes regardless of their dimension, and is superior for energy saving. In order to carry a plurality of pipes simultaneously, however, installation of the lifting sling is complicated, and also synchronous lifting operation is difficult in remote-control.

SUMMARY OF THE INVENTION

It is an object of the invention to provide a lifting sling in which there occurs no distortion and twisting due to loads in carriage of at least one elongated article, and in which a pair of wire rope units can easily and adequately be selected in accordance with dimension and weight of the elongated article, so that the lifting sling is high in utilization.

It is another object of the invention to provide a lifting sling reliable in efficiency of labor saving, in which slinging work can be done quickly by a crane operator only so that efficient carriage can be made possible.

It is still another object of the invention to provide a lifting sling which having a simple and easy constructed structure, and is low in cost of installation, and in which at least one elongated article can be carried safely and efficiently.

It is another object of the invention to provide a lifting sling which is capable of saving energy of slinging work.

It is a further object of the invention to provide a lifting sling having a wide working or operational range with regards to dimensions of at least one elongated article.

According to the invention, there is provided a lifting sling for lifting up at least one elongated article, the lifting sling comprising:

an elongated beam;

hoisting means for a hook unit of a crane, the hoisting means being mounted on the top of the elongated beam;

a pair of hooking means arranged respectively at both ends of the elongated beam;

a pair of wire rope means depending respectively from the pair of hooking means;

a pair of guide arm means having ends, respectively, the ends of the guide arm means being pivotally attached to the elongated beam adjacent the both ends thereof, the pair of guide arm means accommodating and supporting respectively the pair of wire rope means;

a pair of actuator means having ends, respectively, the ends of actuator means being pivotally attached to the elongated beam, the other ends of the respective actuator means being pivotally attached respectively to the pair of guide arm means, the pair of actuator means moving the respective pair of guide arm means toward and away from each other about the end of the respective guide arm means; and control means connected to the pair of actuator means for operating the same to move the pair of guide arm means toward and away from each other.

According to the above lifting sling, it is possible to use the elongated beam which is designed to an optimum dimension or size in accordance with a dimension, form and weight of the elongated article. Thus, the optimum carriage efficiently can be achieved. Further, the elongated beam is simple in construction and is provided at its top with the hoisting means and which has the pair of hooking means at both its ends. Accordingly, in use, it is possible to quickly and efficiently engage and disengage the hoisting means with and from the hook unit of the crane, and to quickly and efficiently engage and disengage the pair of wire rope means and the pair of guide arm means with and from the respective hooking means. Moreover, in the case where the pair of guide arm means are used to guide the respective pair of wire rope means, the pair of actuator means are utilized having ends, respectively. The ends of the actuator means are pivotally connected to the elongated beam and the other ends of the actuator means are pivotally connected to the pair of guide arm means, respectively. Accordingly, it is possible to extremely quickly and reliably guide the pair of guide arm means such that an angle of inclination between the pair of guide arm means is freely adjustable. Furthermore, since the pair of actuator means can freely be operated by the control means which is arranged, for example, in an operation room, it is possible to effect a slinging work safely and efficiently without assistance of operators or workers on the ground.

As described above, since the weight of the elongated article is applied only to the pair of wire rope means, wear on the lifting sling is reduced, so that the lifting sling has an advantage of economical efficiency. Further, since the elongated beam is utilized, it is possible to efficiently carry an elongated article which is long in size. Further, the crane operator can use the control means without the necessity of slinging workers, to freely, quickly and safely carry the elongated article. Thus, the lifting sling considerably contributes to energy saving and an improvement in efficiency of work in various industries.

Preferably, the pair of wire rope means are pivotally attached to the elongated beam, and each of the pair of guide arm means includes a pair of guide arm sections. In this case, the lifting sling further includes a pair of support beams for supporting the pair of guide arm means such that an opening angle between the pair of guide arm means is adjustable. Each of the pair of support beams has an end pivotally connected to the end of the elongated beam. The pair of support beams are arranged respectively between the pair of actuator means and the pair of guide arm means for supporting the same. The other ends of the respective actuator means are pivotally connected respectively to the pair of support beams. A pair of guide actuator means are mounted respectively on the pair of support beams. Each of the pair of guide actuator means is connected to the pair of guide arm sections of a corresponding one of the pair of guide arm means, for moving the pair of guide arm sections toward and away from each other in a plane perpendicular to a plane in which the pair of guide arm means are moved toward and away from each other.

According to the above-mentioned lifting sling, each of the pair of guide actuator means is connected to the pair of guide arm sections of a corresponding one of the pair of guide arm means, for moving the pair of guide arm sections toward and away from each other in a plane perpendicular to a plane in which the pair of guide arm means are moved toward and away from each other. Thus, since it is possible to open and close the pair of guide arm sections of each of the pair of guide arm means, slinging work can be further simplified, and it is possible to increase the working efficiency remarkably.

As described previously, since each pair of guide arm sections are opened and closed by a corresponding one of the pair of guide actuator means, the slinging work or operation of the pair of wire rope means and so on can be further simplified.

Preferably, each of the pair of hooking means includes at least one pivot, and each of the pair of guide arm means has an axis of pivotal movement about the corresponding pivot.

According to the above lifting sling, the axes of pivotal movement of the respective guide arm means are in agreement with the respective axes of the pair of pivots. As a result, no unreasonable friction occurs between the pair of guide arm means and the pair of pivots, and the pair of wire rope means are accurately and quickly guided respectively by the pair of guide arm means.

As described above, since the pair of hooking means include at least one pair of pivots, it can freely insert and withdraw the pair of pivots with respect to the elongated beam. Thus, if at least one pair of predetermined holes are formed in the elongated beam, it is easy to adjust the width of the pair of wire rope means.

Preferably, each of the pair of wire rope means includes at least one pair of wire rope sections. In this case, the lifting sling further includes at least two pairs of detachable joint elements which are arranged respectively at lower ends of the respective pairs of wire rope sections, and at least one pair of replaceable abutments connected respectively between the pairs of joint elements.

According to the above lifting sling, at least two pairs of detachable joint elements are arranged respectively at lower ends of the respective pairs of wire rope sections, and at least one pair of replaceable abutments are connected respectively between the pairs of joint elements. With this arrangement, it is possible to select the pair of abutments which are most suitable for a dimension and form of the elongated article, and it is possible to freely replace the pair of abutments with other ones. Thus, the carriage efficiency is naturally improved, and damage is minimized leading to high economic efficiency.

As described above, since the pair of abutments are suitably replaceable, it is possible to select the pair of abutments which are most adequate for the dimension and the form of the elongated article. Thus, it is possible to improve the transportation or carriage efficiency, and to minimize damage to the lifting sling.

Preferably, each of the pair of wire rope means includes at least one pair of wire rope sections. In this case, the lifting sling further includes at least one pair of abutment means having end abutments which are engageable respectively with both ends of the elongated article.

According to the above lifting sling, since the end abutments of the respective abutment means are engageable respectively with both ends of the elongated article. Thus, it is possible to prevent the end abutments hung on the elongated article, from being moved laterally. That is, no accidents occur in which the elongated article slips off the end abutments of the respective abutment means. Accordingly, it is possible to safely perform work or operations.

Preferably, the above-described lifting sling further includes center bearing means arranged at a center of a lower surface of the elongated beam. The pair of actuator means are mounted on the elongated beam through the center bearing means. A pair of bearing means are mounted on the elongated beam at respective locations between the pair of hooking means and the center bearing means. One end of the respective guide arm means is mounted on the elongated beam through the pair of bearing means. A pair of U-shaped hook means are arranged respectively at forward ends of the respective wire rope means, for engagement with both ends of the elongated article. A pair of guide means are fixedly mounted respectively to forward ends of the pair of guide arm means, for guiding respectively the pair of wire rope means. A pair of spring means extend respectively between the pair of guide means and the pair of U-shaped hook means, for preventing the respective U-shaped hook means from being disengaged from the both ends of the elongated article.

According to the above-mentioned lifting sling, the elongated beam is provided at its top with the hoisting means for the hook of the crane. Thus, engagement and disengagement of the hoisting means with respect to the hook of the crane is easy. The elongated article can be stored at a desirable location, and can be moved quickly as occasion demands so that the elongated article can be used. Further, the construction of the lifting sling is such that the center bearing means are arranged at the center of the lower surface of the elongated beam, the pair of actuator means are mounted on the elongated beam through the center bearing means, and the pair of bearing means are mounted on the elongated beam at respective locations between the pair of hooking means and the center bearing means. Thus, attachment and detachment of the pair of actuator means and the pair of guide arm means is easy, and maintenance and inspection of the lifting sling is simple.

Moreover, the construction of the above lifting sling is such that one end of the respective guide arm means is mounted on the elongated beam respectively through the pair of bearing means, the center bearing means being arranged at the center of the lower surface of the elongated beam, and the pair of actuator means are mounted on the elongated beam through the center bearing means. Furthermore, the pair of guide means are fixedly mounted respectively to forward ends of the pair of guide arm means, for guiding respectively the pair of wire rope means. Accordingly, the pair of guide arm means are moved angularly about the central bearing means, by extension and contraction of the pair of actuator means. Thus, the pair of wire rope means are guided respectively by the pair of guide means such that the pair of wire rope means are freely moved angularly in a direction composed of horizontal and vertical directions, that is, in an inclined direction. Accordingly, it is possible to engage and disengage the pair of U-shaped hook means at the forward ends of the respective wire rope means with and from the elongated article.

Further, the pair of guide arm means of the lifting sling may be formed of integral pieces, or may be in the form of a multi-joint type. For example, the pair of guide arm means may adequately be designed into the form of link arm units which comprise protopodite arms, follower joint arms and extension wire elements. In this case, the pair of guide arm means can freely be moved angularly, operation of the pair of guide arm means is easy, and a guiding function of the pair of guide arm means is high.

Moreover, the pair of guide means of the above lifting sling are fixedly mounted respectively to the forward ends of the pair of guide arm means, for guiding respectively the pair of wire rope means. With the arrangement, when the pair of U-shaped hook means are disengaged from the elongated article, there is no fear that damage such as distortion, twisting, kink, and entanglement of the pair of wire rope means may occur therein. Furthermore, when the elongated article is lifted up, the above lifting sling can withstand reaction force transmitted from the elongated article. It is possible to maintain the positions of the pair of wire rope means, to accurately hold or retain the transportation posture of the elongated article, and to smoothly carry the elongated article to a desirable location.

Further, the pair of spring means of the above lifting sling extend respectively between the pair of guide means and the pair of U-shaped hook means, for preventing the U-shaped hook means from being disengaged from respective ends of the elongated article. Thus, when the elongated article is lifted up, tension force occurs between the pair of U-shaped hook means at the forward ends of the respective wire rope means and the elongated article. Accordingly, the hooking operation is easy, and there is no fear that, during carriage or transportation of the elongated article, the pair of U-shaped hook means will be disengaged from the elongated article so that the elongated article falls down.

Moreover, in the above lifting sling, the pair of actuator means serving as a source of operation each have one end which is pivotally attached to the central bearing means arranged at the center of the lower surface of the elongated beam. The other ends of the respective actuator means are pivotally attached to the respective pair of guide arm means.

According to the above lifting sling, it is possible to operate the pair of guide arm means accurately in synchronous and symmetrical relation to each other. Thus, the efficiency of working or operation is high and the safety is also high.

In the lifting sling constructed as above, hooking operation is done manually, but the hook disengagement operation, which is dangerous and difficult, is done automatically. Thus, it is possible to simplify the construction of the lifting sling, and actual efficiency of the working can be improved, and safety enhanced. Further, since the construction is simple and safety is high, operation of the lifting sling is easy, the installation cost is low, and the maintenance and inspection of the lifting sling are easy. Thus, it is possible to carry or transport individual elongated articles, and to transport a plurality of elongated articles simultaneously, safely and efficiently. Accordingly, considerable saving of energy in the slinging work is possible, and the economical effects are considerable.

Preferably, each of the pair of wire rope means includes a plurality of wire ropes. In this case, each of the pair of guide means is formed into a frame configuration for guiding the wire ropes individually, and each of the spring means includes a plurality of spring elements which are arranged in side-by-side relation to each other and which are associated respectively with the wire ropes of a corresponding one of the pair of wire rope means.

According to the above lifting sling, when the pair of U-shaped hook means are disengaged respectively from a plurality of elongated articles, there is no fear that damages such as distortion, twisting and entanglement of the pair of wire rope means occur therein. Further, when elongated articles are lifted up, the pair of wire rope means can withstand component force in the horizontal direction transmitted from the elongated articles. Thus, it is possible to transport the elongated articles to a desirable location, while accurately maintaining a transporting posture of the elongated articles arranged in side-by-side relation to each other. Further, since the pair of hooking means are arranged respectively at both ends of the elongated beam, it is possible to engage and disengage the wire ropes of desirable number in agreement with the number of elongated articles to be carried. Thus, it is possible to increase transportation efficiency.

Preferably, each of the guide means has at least a part which is made of deformable elastic material.

According to the above lifting sling, in the case where at least part of each of the pair of guide means is made of deformable elastic material such as spring or rubber, there is a very low possibility that, when the pair of guide means are in contact with the pair of wire rope means, the pair of wire rope means are damaged. Thus, maintenance costs can be considerably reduced.

Preferably, the lifting sling further includes center bearing means arranged at a center of a lower surface of the elongated beam. The pair of actuator means are mounted on the elongated beam through the center bearing means. A pair of bearing means is mounted on the elongated beam at respective locations between the pair of hooking means and the center bearing means. Ends of the respective guide arm means are mounted on the elongated beam respectively through the pair of bearing means. A pair of U-shaped hook means are arranged respectively at forward ends of the respective wire rope means, for engagement with both ends of the elongated article. A pair of guide means are fixedly mounted respectively to forward ends of the pair of guide arm means, for guiding respectively the pair of wire rope means. A pair of abutments are arranged respectively at the forward ends of the respective guide arm means. Each of the guide arm means pivotally guide the corresponding guide means through the abutments. A pair of spring means extend respectively between the pair of guide means and the pair of U-shaped hook means, for preventing the U-shaped hook means from being disengaged from the respective ends of the elongated article. A pair of hanging rope means have one of their ends mounted on the elongated beam. The pair of guide means are mounted on the respective other ends of the pair of hanging rope means.

According to the above-described lifting sling, there is provided advantages similar to those described previously. Further, the construction of the lifting sling is such that the pair of guide means are arranged respectively at forward ends of the pair of guide arm means, for guiding respectively the pair of wire rope means. Thus, when the pair of wire rope means are guided in the slinging work, the pair of guide means freely move in accordance with movement of the pair of wire rope means. Due to the guiding, there is no fear that damages such as distortion, twisting, kink, and entanglement of the pair of wire rope means will occur therein. Further, due to the effect of separation, it is possible to provide a sufficient damage prevention function. Furthermore, the construction of the lifting sling is such that the pair of guide arm means are pivotally attached to the respective central bearing means. By extension and contraction of the pair of actuator means, the pair of guide arm means are moved angularly about their respective bearing means. The pair of guide arm means are altered in their position such that the pair of guide means freely swing by means of the abutments in a direction composed of horizontal and vertical directions, that is, in an inclined direction. As a result, the pair of wire rope means are moved in the inclined direction, and the pair of U-shaped hook means are guided vertically. Thus, it is possible to freely disengage the pair of U-shaped hook means from the elongated article. Moreover, since the pair of actuator means are mounted between the central bearing means and the respective guide arm means, control of the pair of actuator means makes it possible to easily and accurately operate the pair of guide arm means in symmetrical relation to each other. Thus, the slinging work can be done efficiently and safely.

With the above arrangement of the lifting sling, the construction is simple and, in addition, is solid and strong. The operation of the lifting sling is easy, and the safety is high. Thus, it is possible to efficiently carry or transport elongated articles. Further, a plurality of elongated articles can be simultaneously be transported. Accordingly, the considerable saving of labor makes it possible to remarkably reduce transportation costs resulting in significant economical savings.

Preferably, each of the guide means has at least part which is made of a deformable elastic material.

According to the above lifting sling, at least part of each of the pair of guide means is made of deformable elastic material such as springs or rubber. With such an arrangement, there is no fear that, when the pair of guide means are into contact with the respective pair of wire rope means, the wire rope units will be damaged. Further, when the elongated article is lifted up, the pair of guide means can withstand the horizontal force transmitted through the pair of wire rope means. Thus, it is possible to smoothly load the pair of wire rope means.

Preferably, each of the pair of wire rope means includes a plurality of wire ropes. In this case, each of the pair of guide means is formed into a frame configuration for guiding the wire ropes individually, and each of the pair of spring means includes a plurality of spring elements which are arranged in side-by-side relation to each other and which are associated respectively with the wire ropes of a corresponding one of the pair of wire rope means.

According to the above lifting sling, the following advantages are obtained. That is, when the wire ropes are guided during the slinging work, the pair of guide means can freely follow the movement of the wire ropes. By this guide effect, damage such as twisting, distortion, kink, and entanglement does not occur in the wire ropes. By the separating effect, it is possible to provide a sufficient damage prevention function for each of the plurality of wire ropes. Further, the spring elements are provided individually for the respective wire ropes. Thus, when a plurality of elongated articles are lifted up, tension force occurs between the elongated articles and the U-shaped hook means at the forward ends of the respective wire rope means. The tension force ensures that the U-shaped hook means are disengaged from the elongated articles. In addition, when the elongated articles are lifted up, there is no fear of the pair of U-shaped hook means becoming disengaged from the elongated articles. When the elongated articles are lifted up, the wire ropes can withstand component force in the horizontal direction transmitted from the elongated articles. Thus, it is possible to carry the elongated articles to a desirable location, while accurately maintaining a transportation posture in which the elongated articles are arranged in side-by-side relation.

Preferably, each of the pair of guide means has at least a part which is made of deformable elastic material.

According to the above lifting sling, there are provided advantages similar to those described previously.

Preferably, each of the pair of the guide arm means includes a protopodite arm having one end which is pivotally attached to a corresponding one of the pair of bearing means, a follower arm, a joint through which the protopodite arm is pivotally connected to the follower arm, and wire means extending between the one end of the protopodite arm and the other end of the follower means.

According to the above lifting sling, it is possible to increase the working area or range by cooperation between the pair of guide arm means and the pair of guide means which are suspended so as to increase the range of angular movement. Thus, it is possible to quickly cope with a change or variation in dimensions for each lot of the elongated articles.

DETAILED DESCRIPTION OF THE INVENTION

Figure 1:
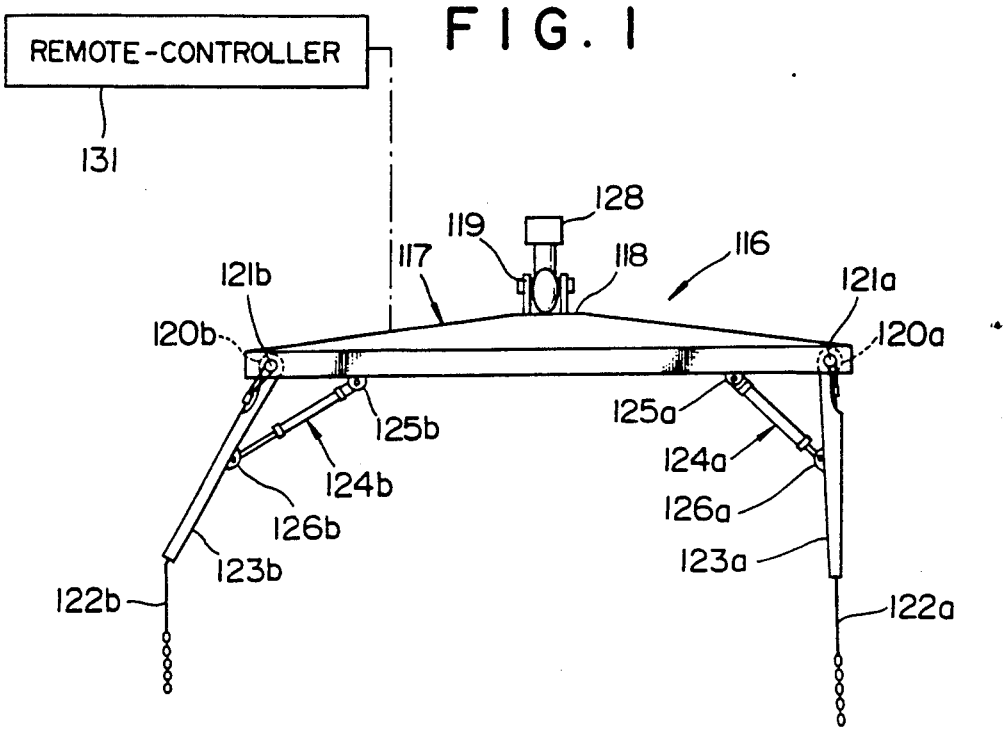
FIG. 1 is a schematic front elevational view of a lifting sling for at least one elongated article to be carried, according to a first embodiment of the invention.

Referring first to FIG. 1, there is shown a lifting sling 116 for at least one elongated article, according to a first embodiment of the invention. The lifting sling 116 comprises an elongated horizontal lifting beam 117 which is made of a metallic rigid body. The elongated beam 117 has a top 118 at which a hoisting member 119 for a crane hook is arranged. The elongated beam 117 also has ends 120*a* and 120*b* which are provided respectively with detachable pivots 121*a* and 121*b*. The pivots 121*a* and 121*b* are one example of a pair of hooking sections from which a pair of respective wire rope units 122*a* and 122*b* are hung or suspended.

That is, the pair of wire rope units 122*a* and 122*b* pivotally are hung from the pair of respective pivots 121*a* and 121*b*. A pair of guide arm units 123*a* and 123*b* are provided which slidably accommodate and support the respective wire rope units 122*a* and 122*b*. The guide arm units 123*a* and 123*b* are also suspended from the pair of respective pivots 121*a* and 121*b*. The guide arm units 123*a* and 123*b* are U-shape or channel shape in cross-section, and can accommodate and support the respective wire rope units 122*a* and 122*b*.

A pair of actuators 124*a* and 124*b* such as operational cylinders each have one end 125*a* and 125*b* pivotally attached to the elongated beam 117. The other ends 126*a* and 126*b* of the respective actuators 124*a* and 124*b* are pivotally attached to the respective guide arm units 123*a* and 123*b*.

The pair of actuators 124*a* and 124*b* are connected to a remote-controller 131 which extends and contracts rods of the respective actuators 124*a* and 124*b*. The remote-controller 131 is a well-known pneumatic, hydraulic or electric remote-controller. The remote-controller 131 has a body which is normally mounted on an operation room or on a crane girder such that the remote-controller 131 can be operated from an operation panel of the operational room. The remote-controller 131 is well known in its operation and control, and a detailed description of the remote-controller 131 will be omitted.

The right-hand wire rope unit 122*a* and its guide arm unit 123*a* illustrated in FIG. 1 are in their waiting condition. On the other hand, the left-hand wire rope unit 122*b* and its guide arm unit 123*b* are in a condition in which the actuator 124*b* is operated from its waiting condition to extend its rod. That is, the wire rope unit 122*b* and the guide arm unit 123*b* are in a condition just before a slinging work condition.

Figure 2:
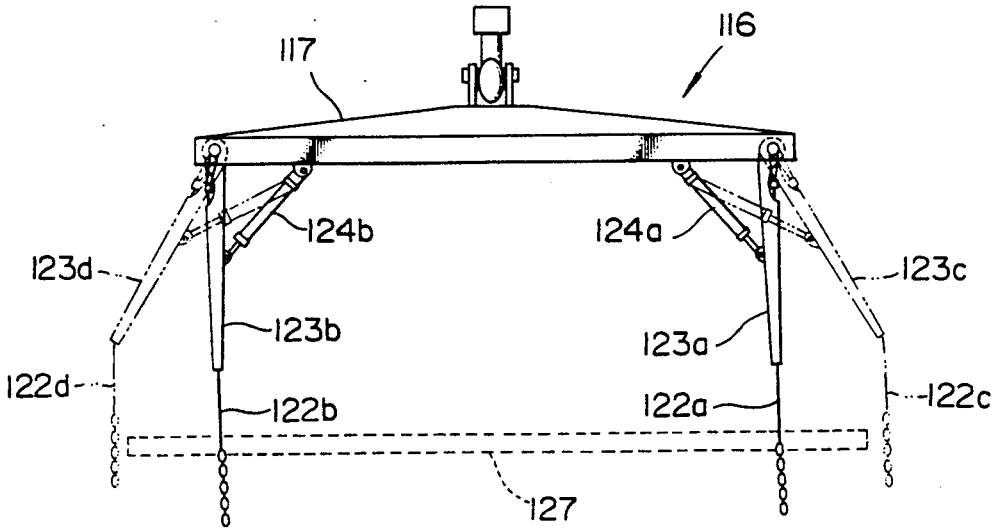
FIG. 2 is a view similar to FIG. 1, but showing a condition just before the elongated article is hung by a pair of wire rope units illustrated by the double dotted lines.
Figure 3:
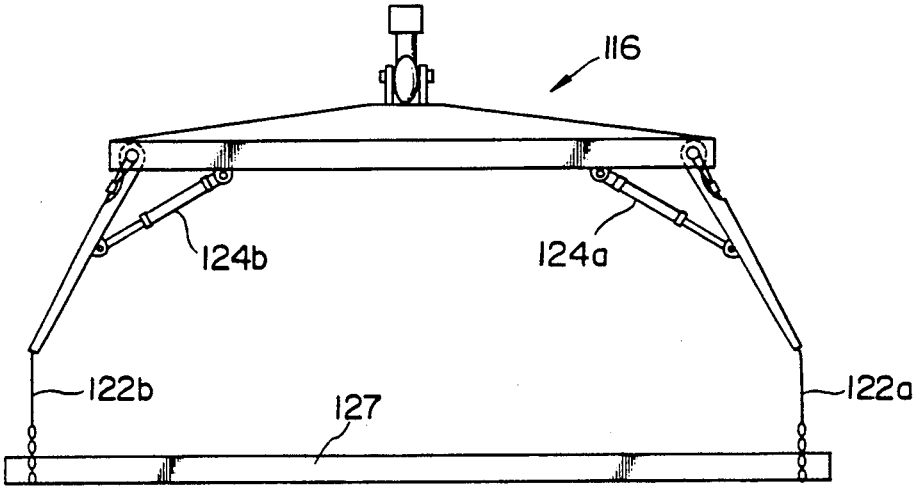
FIG. 3 is a view similar to FIG. 1, but showing a condition just after the elongated article has been hung by the pair of wire rope units.

FIG. 2 shows the following condition. That is, the pair of actuators 124*a* and 124*b* are actuated from their waiting condition to move the respective guide arm units 123*a* and 123*b* to their positions 123*c* and 123*d* as shown by the double dotted lines. The wire rope units 122*a* and 122*b* are lifted up to their respective positions 122*c* and 122*d* as shown by the double dotted lines. Thus, the wire rope units 122*a* and 122*b* are placed in the condition just before engagement with an elongated article 127 to be carried. FIG. 3 illustrates the wire rope units 122*a* and 122*b* which are in engagement with the elongated article 127.

Figure 4:
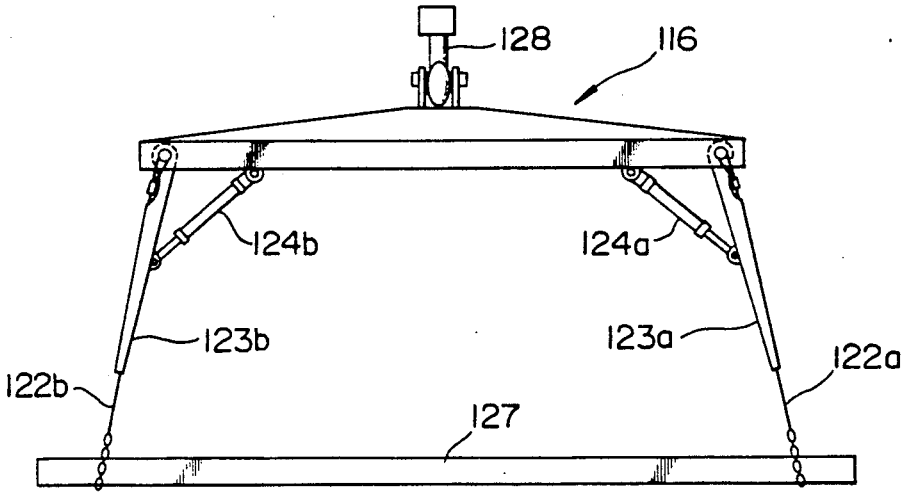
FIG. 4 is a view similar to FIG. 1, but showing a condition in which the elongated article has been hung by the pair of wire rope units.

FIG. 4 illustrates the next condition. Specifically, a crane hook 128 is wound up causing the wire rope units 122*a* and 122*b* to hang the elongated article 127 therefrom.

If a pair of pneumatic cylinders are used as the respective actuators 124*a* and 124*b*, the pneumatic cylinders per se have a cushioning action. Accordingly, when the elongated article 127 is hung, the guide arm units 123*a* and 123*b* in the form of a wing are closed, that is, are moved toward each other under a load of the elongated article 127, even if the pneumatic cylinders are not deactivated. In this case, the respective thrust forces exerted by the pneumatic cylinders to operate against the gravitational force of the respective guide arm units 123*a* and 123*b* are small as compared with the load of the elongated article 127, and consequently no excessive force is applied to the guide arm units 123*a* and 123*b*.

In connection with the above, if hydraulic cylinders or electric actuators are used as the actuators 124*a* and 124*b*, a pair of cushioning mechanisms may be necessarily provided respectively between the cylinders and the guide arm units 123*a* and 123*b*.

As described above, according to the first embodiment, a load is applied only to the pair of wire rope units 122*a* and 122*b*, and no significant load apart from the thrust forces from the actuators 124*a* and 124*b* is applied to the guide arm units 123*a* and 123*b*.

Thus, according to the first embodiment, only one operator is required to remote-control the lifting sling to quickly do the slinging work so that the elongated article 127 can be carried safely and reliably.

Figure 5:
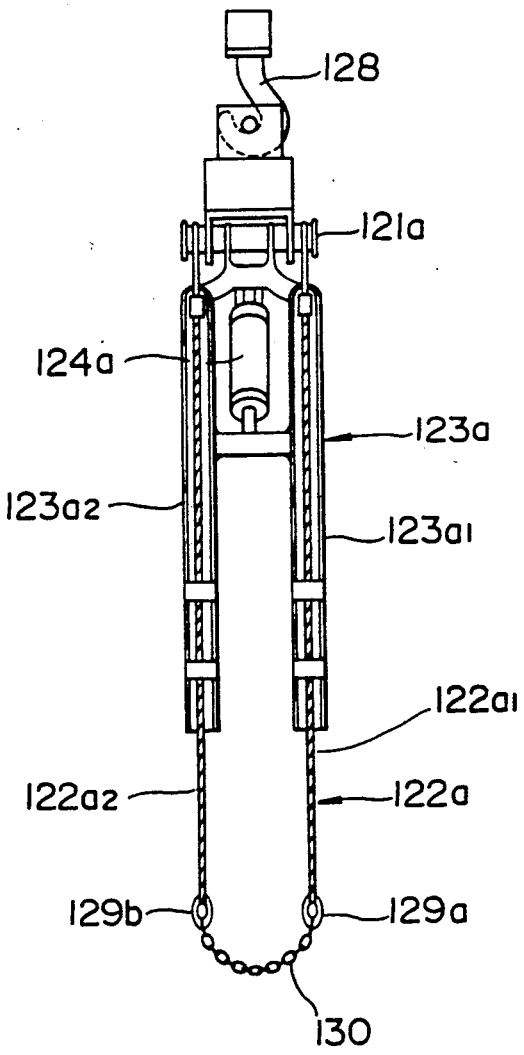
FIG. 5 is a schematic side elevational view of one of the pair of wire rope units and one of a pair of guide arm units of the lifting sling illustrated in FIG. 1.

FIG. 5 schematically shows one of the pair of wire rope units 122*a* and 122*b* and one of the pair of guide arm units 123*a* and 123*b*. The guide arm unit 123*a* has a pair of arm sections 123$a_1$ and 123$a_2$, and is pivotally supported by the pivot 121*a*, so that its axis is the same as the pivotal or angular movement axis of the wire rope unit 122*a*. With such an arrangement, no shift in position occurs between the wire rope unit 122*a* and the guide arm unit 123*a* during guidance and slinging work with respect to the elongated article 127. Accordingly, no unreasonable sliding occurs between the wire rope unit 122*a* and the guide arm unit 123*a*. Thus, guidance is accurately effected, and the operation can quickly be done.

In the first embodiment, the pair of guide arm units 123*a* and 123*b* are U-shape in cross-section, that is, they have a channel shape, and slidably accommodate the respective wire rope units 122*a* and 122*b*. However, the guide arm units 123*a* and 123*b* may take any suitable form such as plate or strip form, if they comprise a mechanism to prevent the wire rope units 122*a* and 122*b* from slipping down, for example, guide bars or hooks.

As shown in FIG. 5, each of the wire rope units 122*a* and 122*b* is composed of pair of wire ropes 122$a_1$ and 122$a_2$. Each of the wire ropes 122$a_1$ and 122$a_2$ has lower ends at which a detachable joint elements 129*a* and 129*b* is provided. The joint elements 129*a* and 129*b* are connected to each other through a replaceable abutment 130 which is adapted to be in contact with the elongated article 127. The abutment 130 is selected from a wire rope or a chain in order to be suitable for the elongated article 127. In addition, it is possible to replace only the wire rope or chain of the abutment 130 with new one when it becomes worn. Thus, the use of the abutment 130 is economically advantageous.

Figure 6:
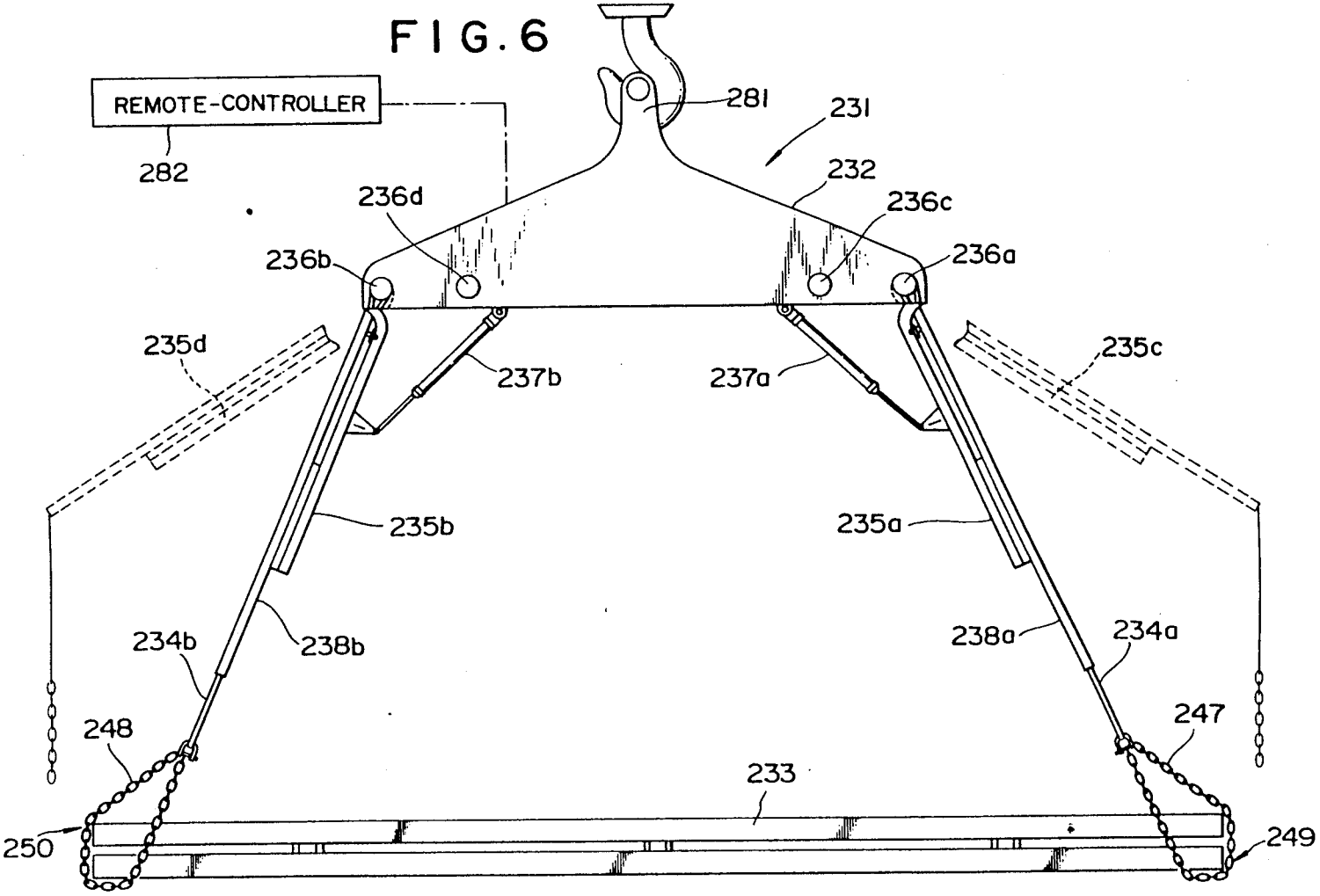
FIG. 6 is a schematic front elevational view of a lifting sling for at least one elongated article to be carried, according to a second embodiment of the invention.

Referring next to FIG. 6, there is shown a lifting sling 231 for at least one elongated article to be carried, according to a second embodiment of the invention, which has more superior function and advantages over the first embodiment. The lifting sling 231 comprises an elongated horizontal lifting beam 232 which is made of a metallic rigid body. At the top of the elongated beam 232, a hoisting member 281 for a crane hook is arranged, similar to the first embodiment. The elongated beam 232 also has both its ends provided respectively with a pair of outer detachable pivots 236*a* and 236*b* and a pair of inner detachable pivots 236*c* and 236*d*. The pivots 236*a*, 236*b*, 236*c* and 236*d* are examples of pairs of hooking sections from which a pair of wire rope units 234*a* and 234*b* are hung or suspended. The pivots 236*a*, 236*b*, 236*c* and 236*d* are provided so that depending on the longitudinal size or dimension of an elongated article 233 to be carried, the center axes of pivotal or angular movement of the respective wire rope units 234*a* and 234*b* and a pair of support beams 235*a* and 235*b* can be changed whereby the lifting sling 231 can most stably lift up and carry the elongated article 233.

In connection with the above, although not shown, it is also possible to change or alter respective mounting positions of a pair of actuators 237*a* and 237*b* with respect to the elongated beam 232. The actuators 237*a* and 237*b* may be cylinders which are operated pneumatically, hydraulically or electrically. The pair of actuators 237*a* and 237*b* are connected to a remote-controller 282 which extends and contracts rods of the respective actuators 237*a* and 237*b*. The remote-controller 282 is a well-known pneumatic, hydraulic or electric remote-controller, and may be similar to the remote-controller 131 illustrated in FIG. 1.

The pair of wire rope units 234*a* and 234*b* and the pair of support beams 235*a* and 235*b* are pivotally supported respectively by the pivots 236*a* and 236*b*. The support beams 235*a* and 235*b* are moved angularly toward and away from each other about the respective pivots 236*a* and 236*b* by the actuators 237*a* and 237*b*.

The support beams 235*a* and 235*b* are each provided with an actuator 241 (shown in FIGS. 7 and 8) subsequently to be described, for the wire rope units 234*a* and 234*b* and a pair of guide arm units 238*a* and 238*b*. The support beams 235*a* and 235*b* support the respective guide arm units 238*a* and 238*b* such that they can be moved angularly toward and away from each other about the respective pivots 236*a* and 236*b*.

When the support beams 235*a* and 235*b* are moved angularly away from each other as indicated by the broken lines 235*c* and 235*d* in FIG. 6, rods of the respective actuators 237*a* and 237*b* are extended to increase an opening angle or width between the wire rope units 234*a* and 234*b*. Accordingly, it is possible to freely provide an opening width between the wire rope units 234*a* and 234*b* to coincide with length of the article 233 to be carried. Thus, efficient slinging work is made possible.

Figure 7:
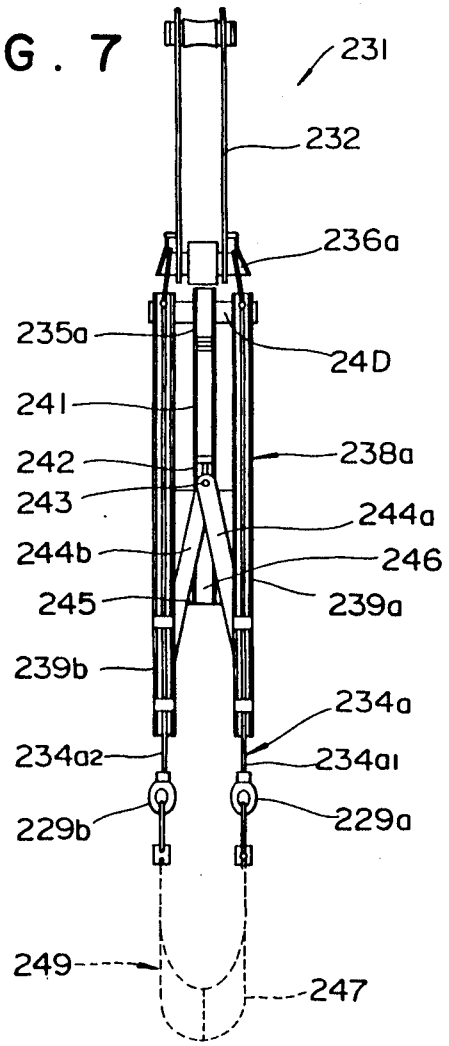
FIG. 7 is a schematic side elevational view of one of a pair of support beams and one of a pair of guide arm units of the lifting sling illustrated in FIG. 6.

FIG. 7 is a schematic side elevational view of one of the pair of support beams 235*a* and 235*b* and one of the pair of guide arm units 238*a* and 238*b*. The guide arm unit 238*a* is composed of a pair of hand arms 239*a* and 239*b*. A support frame 240 is fixedly mounted on the support beam 235*a*. The hand arms 239*a* and 239*b* are supported by the support frame 240 so as to be movable angularly toward and away from each other in a plane perpendicular to a plane in which the pair of support beam 235*a* and 235*b* and the pair of wire rope units 238*a* and 238*b* shown in FIG. 6 are moved angularly toward and away from each other.

The aforesaid actuators 241 for the respective pairs of support beams 235*a* and 235*b* are composed of respective cylinders. As shown in FIG. 7, the actuator 241 has its extensible rod 242 which is connected to the pair of hand arms 239*a* and 239*b* through a pin 243 and a pair of link bars 244*a* and 244*b*. Thus, the pair of hand arms 239*a* and 239*b* are movable angularly toward and away from each other in the aforesaid plane in a symmetric manner.

Figure 8:
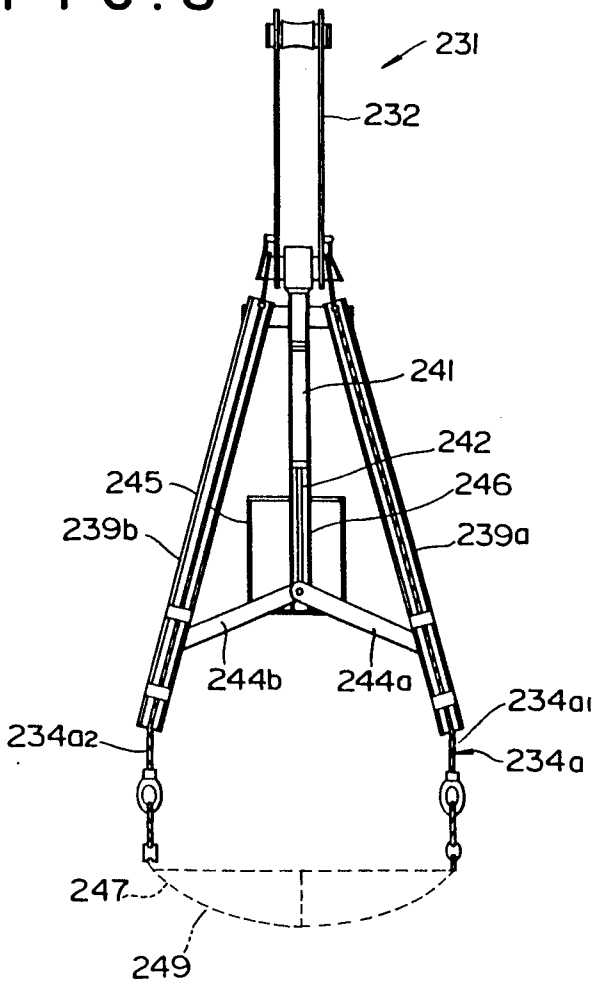
FIG. 8 is a view similar to FIG. 7, but showing a pair of hand arms of the guide arm unit illustrated in FIG. 7, the pair of hand arms being moved away from each other.

In FIGS. 7 and 8, a center of a guide plate 245 for the pair of link bars 244*a* and 244*b* is provided with a guide groove 246 for the extensible rod 242 and the pin 243. The guide plate 245 serves to guidingly support the link operation of the link bars 244*a* and 244*b*.

As described above, in the lifting sling 231, it is possible to freely adjust the opening angle of the hand arms 239*a* and 239*b* in accordance with the dimension and configuration of the elongated article 233, whereby the opening width between a pair of wire ropes 234*a*$_1$ and 234*a*$_2$, which cooperate with each other to form the wire rope unit 234*a*, can be altered. Thus, the lifting sling 231 can be applied to various articles to be carried, and the utilization factor of the lifting sling 231 is remarkably high.

As shown in FIG. 6, each of the wire rope units 234*a* and 234*b* has a lower end to which one of load abutment chain units 249 and 250 is mounted in the form of a ring. The load abutment chain units 249 and 250 have their respective end abutment chains 247 and 248 which are adapted to be abutted respectively against the both ends of the elongated article 233. Thus, the load abutment chain units 249 and 250 can engage with the elongated article 233 without movement of the chain units 249 and 250 from the ends of the article 233. Accordingly, it is possible to prevent the chain units 249 and 250 from slipping off at carriage or transportation so that no accident occurs.

Figure 9:
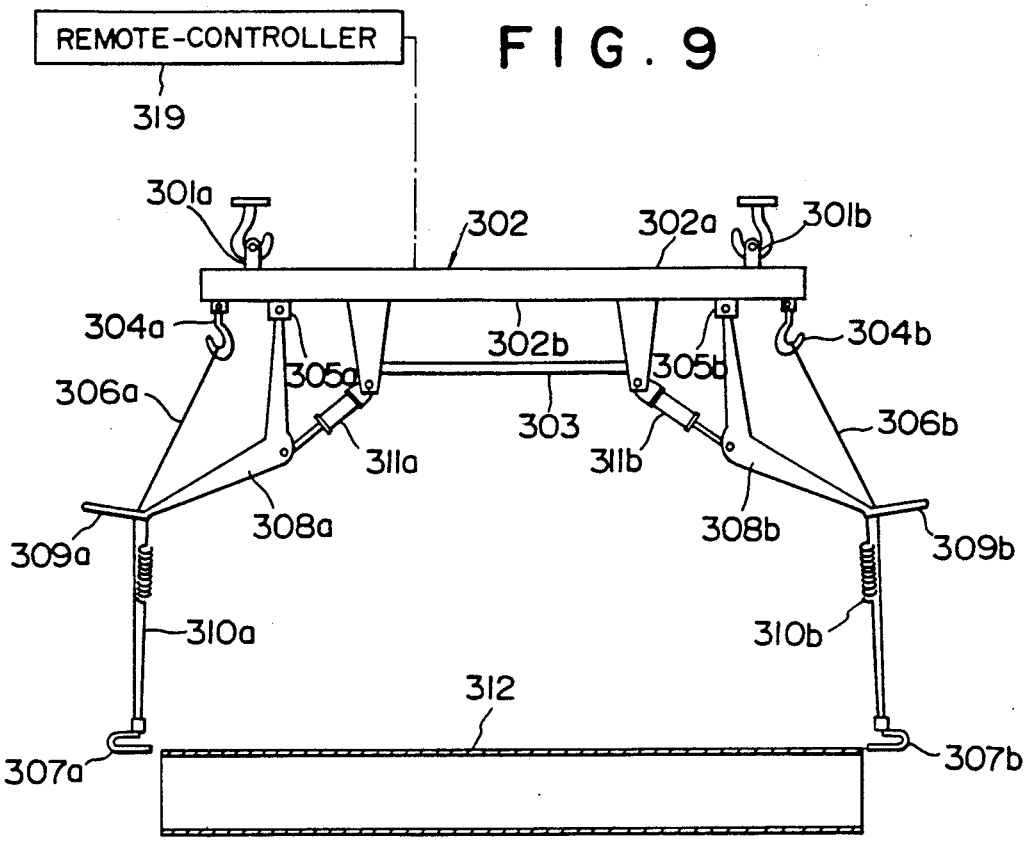
FIG. 9 is a schematic front elevational view of a lifting sling for at least one elongated article to be carried, according to a third embodiment of the invention.

Referring to FIG. 9, there is shown a lifting sling for at least one elongated article to be carried, according to a third embodiment of the invention. The lifting sling is used to lift up at least one elongated article 312 such as a pipe. A pair of crane hoisting elements 301*a* and 301*b* are fixedly mounted on respective ends of an upper surface 302*a* of an elongated horizontal lifting beam 302. An elongated bearing element 303 for a pair of actuators 311*a* and 311*b* is fixedly mounted at a center of a lower surface 302*b* of the elongated beam 302. A pair of hooks 304*a* and 304*b* for respective wire rope units 306*a* and 306*b* are fixedly mounted to respective ends of the lower surface 302*b* of the elongated beam 302. A pair of bearing elements 305*a* and 305*b* for respective guide arm units 308*a* and 308*b* are fixedly mounted on the lower surface 302*b* of the elongated beam 302 at locations between the crane hoisting elements 301*a* and 301*b*, and centering about the bearing element 303. That is, the pair of bearing elements 305*a* and 305*b* are arranged between the respective hooks 304*a* and 304*b* and the bearing element 303.

The pair of wire rope units 306*a* and 306*b* for suspending the elongated article 312 therefrom have respective lower ends at which a pair of U-shaped hook units 307*a* and 307*b* are provided in facing relation to each other. The wire rope units 306*a* and 306*b* are detachably hung from the respective hooks 304*a* and 304*b*. The guide arm units 308*a* and 308*b* are attached to the respective bearing elements 305*a* and 305*b* so as to be movable angularly thereabout toward and away from each other in a plane including the elongated beam 302 The guide arm units 308*a* and 308*b* have respective lower ends to which a pair of guide units 309*a* and 309*b* are fixedly mounted respectively. The guide units 309*a* and 309*b* serve to slidably guide the respective wire rope units 306*a* and 306*b*.

A pair of spring units 310*a* and 310*b* are provided which extend respectively between the guide units 309*a* and 309*b* and the lower ends of the wire rope units 306*a* and 306*b*, for example, the U-shaped hook units 307*a* and 307*b*. The spring units 310*a* and 310*b* serve to prevent the hook units 307*a* and 307*b* from slipping off from the elongated article 312. The pair of actuators 311*a* and 311*b* such as operational cylinders are mounted between the bearing element 303 and the respective guide arm units 308*a* and 308*b*. The actuators 311*a* and 311*b* are connected to a remote-controller 319 which is similar in construction to the remote-controller 131 shown in FIG. 1 and which is known well per se. As the actuators 311*a* and 311*b*, pneumatic, hydraulic or electrical cylinders may be used. A driving source and piping for the cylinders are known well, and the description and illustration thereof are omitted.

Figure 10:
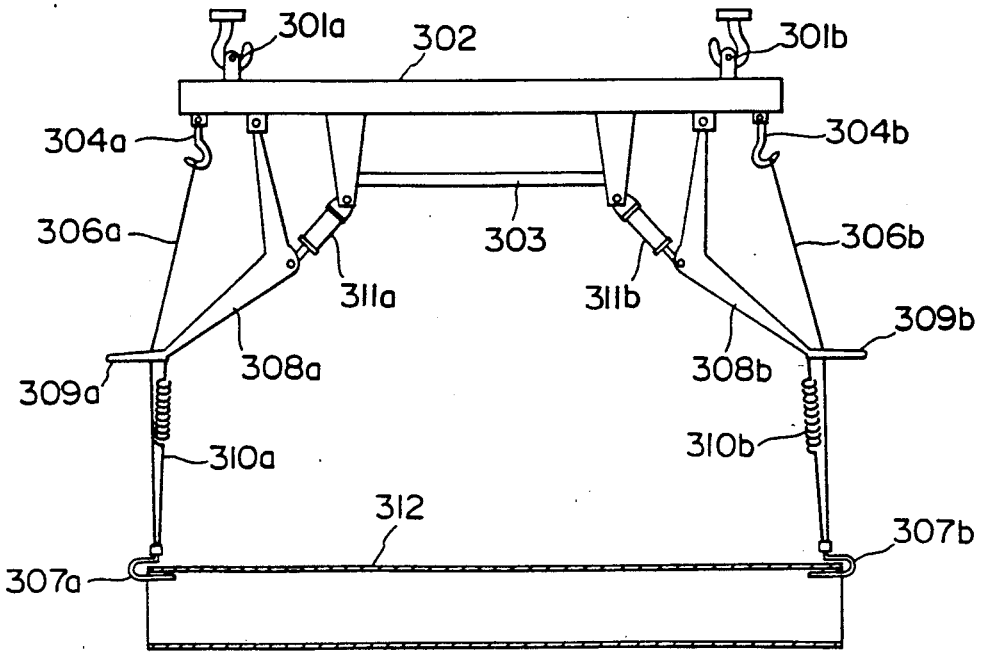
FIG. 10 is a view similar to FIG. 9, but showing a pair of wire rope units which are engaged with the elongated article.

FIG. 9 shows a condition just before lifting-up of the elongated article 312 such as a pipe. When the actuators 311*a* and 311*b* are operated from the condition illustrated in FIG. 9 in such a direction that rods of the respective actuators 311*a* and 311*b* are retracted to move the guide arm units 308*a* and 308*b* angularly toward each other as shown in FIG. 10, the wire rope units 306*a* and 306*b* are moved toward a longitudinal center of the elongated article 312. Accordingly, it is possible for a slinging worker to easily hang the U-shaped hook units 307*a* and 307*b* on respective ends of the elongated article 312.

Further, at this time, since tension forces due to the respective spring units 310*a* and 310*b* act upon the respective U-shaped hook units 307*a* and 307*b*, it is possible to ensure that the U-shaped hook units 307*a* and 307*b* are maintained in engagement with the elongated article 312.

As described above, in the lifting sling according to the third embodiment, operation is done manually whereby the U-shaped hook units 307*a* and 307*b* are placed in engagement with the elongated article 312. However, it is also possible to automatically disengage the U-shaped hook units 307*a* and 307*b* from the elongated article 312, which tends to be accompanied with danger when done manually. Thus, construction of the lifting sling can be simplified, actual efficiency of the operation can be improved, and safety can be raised.

Figure 11:
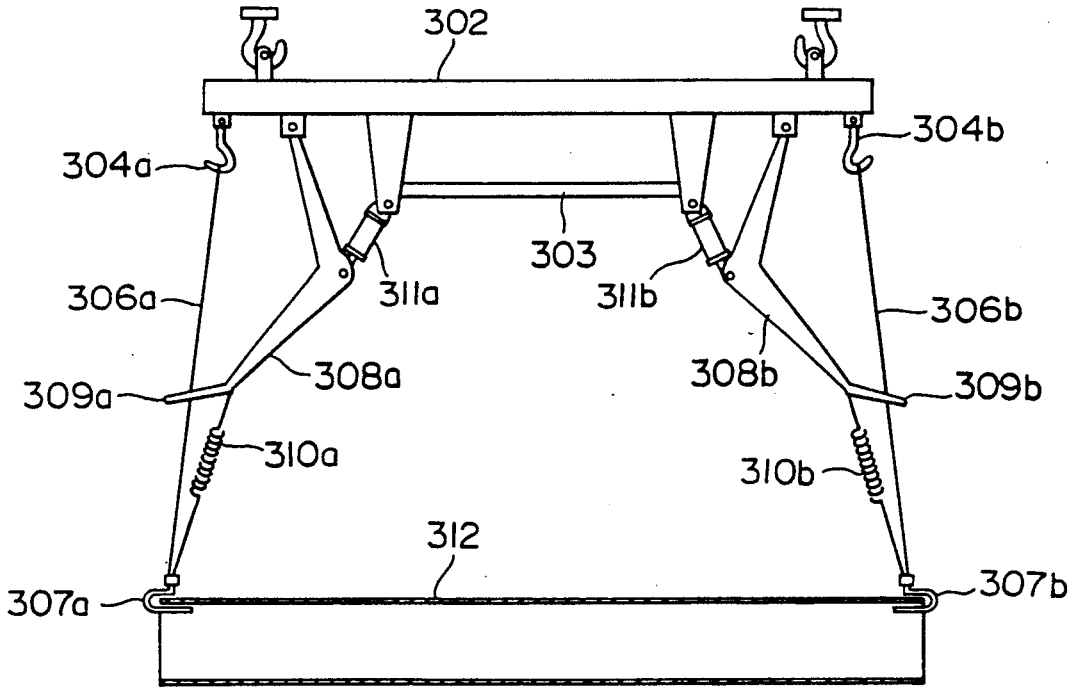
FIG. 11 is a view similar to FIG. 9, but showing a pair of actuators whose rods are withdrawn or retracted.

FIG. 11 shows a condition under which the rods of the respective actuators 311*a* and 311*b* are further retracted to move the guide arm units 308*a* and 308*b* angularly toward each other. The angular movements of the respective guide arm units 308*a* and 308*b* loosen restriction with respect to the wire rope units 306*a* and 306*b*. Under the condition illustrated in FIG. 11, the elongated article 312 is lifted up. In this posture, the guide units 309*a* and 309*b* are further moved toward the longitudinal center of the elongated article 312. This results in strong action of the tension forces of the respective spring units 310*a* and 310*b*, upon the respective U-shaped hook units 307*a* and 307*b*. Thus, there is no fear that the elongated article 312 will slip off from the U-shaped hook units 307*a* and 307*b* and fall down onto the ground.

When the elongated article 312 is unloaded onto a working floor, the rods of the respective actuators 311*a* and 311*b* are extended in contrast with the above lifting-up condition. At this time, the wire rope units 306*a* and 306*b* are pushed outwardly to disengage the U-shaped hook units 307*a* and 307*b* from the elongated article 312. In this case, assistance is not required at all.

Normally, an operator of the crane operates the remote-controller 319 to drive the pair of actuators 311*a* and 311*b*. It is needless to say, however, that the remote-controller 319 can be operated by radio control or some other wireless method.

Figure 12:
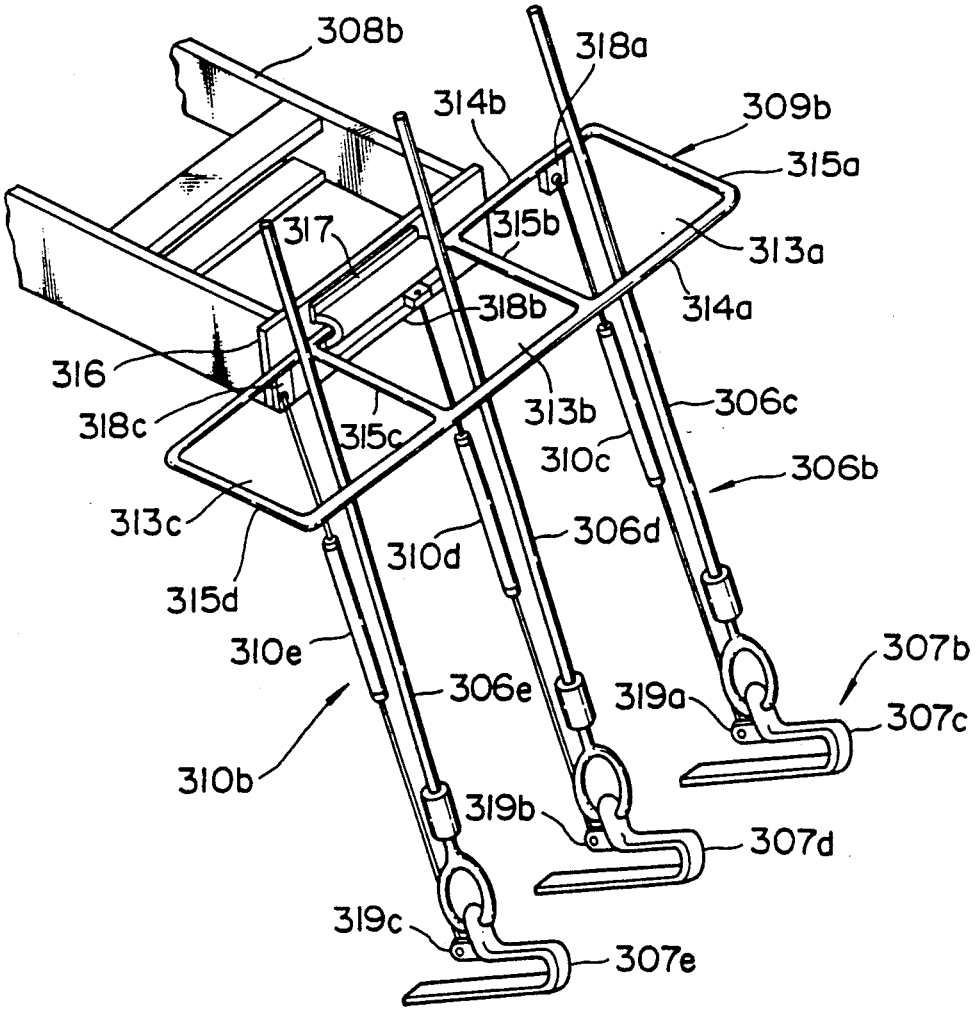
FIG. 12 is a perspective view of an example of a specific construction of the wire rope unit illustrated in FIGS. 9 through 11.

Referring next to FIG. 12, there is shown a specific example of an assembly which comprises one of the pair of guide units 309*a* and 309*b*, one of the pair of wire rope units 306*a* and 306*b*, one of the pair of spring units 310*a* and 310*b* and one of the pair of hook units 307*a* and 307*b*.

In this specific example, each of the guide units 309*b* is formed into a frame configuration which is composed of a pair of lateral frame elements 314*a* and 314*b* and four longitudinal frame elements 315*a*, 315*b*, 315*c* and 315*d*. The lateral frame elements 314*a* and 314*b* and the longitudinal frame elements 315*a*, 315*b*, 315*c* and 315*d* cooperate with each other to form three windows 313*a*, 313*b* and 313*c*. The windows 313*a*, 313*b* and 313*c* slidably guide three wire ropes 306*c*, 306*d* and 306*e* of the wire rope unit 306*b*, respectively.

The guide unit 309*b* is fixedly mounted, through a holder 317, to an abutment plate 316 which is fixedly mounted on an end face of the guide arm unit 308*b*. Three support members 318*a*, 318*b* and 318*c* for respective spring elements 310*c*, 310*d* and 310*e* of the spring unit 310*b* are fixedly mounted on the lateral frame element 314*b* or the abutment plate 316.

Each of the U-shaped hook units 307*b* is composed of three U-shaped hooks 307*c*, 307*d* and 307*e*. These U-shaped hooks 307*c*, 307*d* and 307*e* have their base ends at which hooking elements 319*a*, 319*b* and 319*c* are projectingly provided. The spring elements 310*c*, 310*d* and 310*e* extend respectively between the support elements 318*a*, 318*b* and 318*c* and the hooking elements 319*a*, 319*b* and 319*c*.

The guide unit 309*b* is suitably made of a metallic frame, a rubber frame, a plastic frame or the like, or is suitably made of elastic or resilient material such as a metallic spring unit or the like. If the body of the guide unit 309*b* is made in whole or in part of a deformable elastic material, there is little likelihood that the wire ropes 306*c*, 306*d* and 306*e* will be damaged when the guide unit 309*b* comes into contact with the wire ropes 306*c*, 306*d* and 306*e*. Thus, it is possible to reduce the maintenance costs considerably.

Further, although the guide unit 309*b* is in a rectangular frame configuration, the guide unit 309*b* is not limited to this specific configuration. That is, the guide unit 309*b* may be in a circular or elliptical configuration. Moreover, parts of the body of the guide unit 309*b*, that is, the longitudinal frame elements 315*a*, 315*b*, 315*c* and 315*d*, the lateral frame element 314*a* and so on may be made of resilient or elastic ropes.

Furthermore, it has been indicated that each of the frame guide units 309*a* and 309*b* has three windows 313*a*, 313*b* and 313*c*. However, the number of windows is optional, and one or more windows may be formed in the frame guide unit. The inventors of this application have manufactured a frame guide unit which has eight windows and have obtained superior results.

Figure 13:
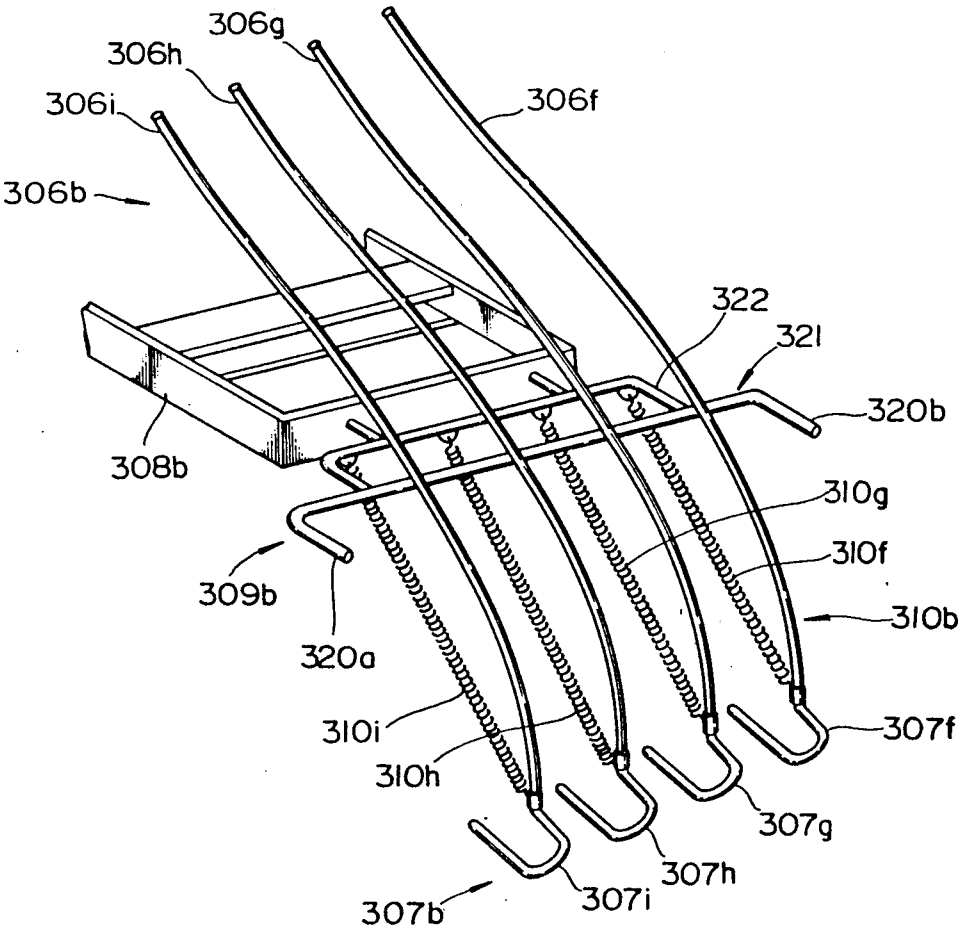
FIG. 13 is a perspective view of an example of another construction of the wire rope unit illustrated in FIGS. 9 through 11.

Referring next to FIG. 13, there is shown another specific example of an assembly which comprises one of the pair of guide units 309*a* and 309*b*, one of the pair of wire rope units 306*a* and 306*b*, one of the pair of spring units 310*a* and 310*b* and one of the pair of hook units 307*a* and 307*b*.

In this specific example, each of the guide units 309*b* is made of a metallic rod-like element 321 whose ends are formed into a pair of hooks 320*a* and 320*b* for preventing the wire rope unit 306*b* from slipping off from the rod-like element 321. The rod-like element 321 is fixedly mounted on the guide arm unit 308*b* through a support arm 322. In this connection, a long rod-like loop guide may be used in substitution for the rod-like element having the hooks 320*a* and 320*b*.

The function of the guide unit 309*b* is to slidably guide wire ropes 306*f*, 306*g*, 306*h* and 306*i* which cooperate with each other to form the wire rope unit 306*b*. The guide unit 309*b* may be designed to be any suitable form as long as the invention does not depart from its original object.

In the specific example illustrated in FIG. 13, the hook unit 307*b* is composed of four hooks 307*f* through 307*i*, and the spring unit 310*b* is composed of four spring elements 310*f* through 310*i*. These hooks and spring elements are the same as those illustrated in FIG. 12, and a description of these hooks and spring elements is omitted to avoid duplication.

Figure 14:
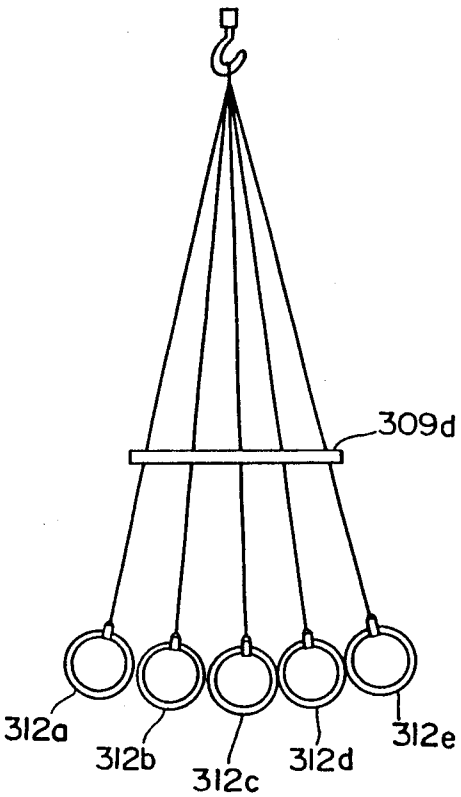
FIG. 14 is a schematic side elevational view of a plurality of pipes to be carried, which are hung in side-by-side relation to each other by the lifting sling illustrated in FIGS. 9 through 11.

FIG. 14 is a schematic view for explanation of utilization of a frame guide unit 309*d* having five windows, to suspend therefrom five elongated articles to be carried, that is, five pipes 312*a* through 312*e* in side-by-side relation to each other.

Figure 15:
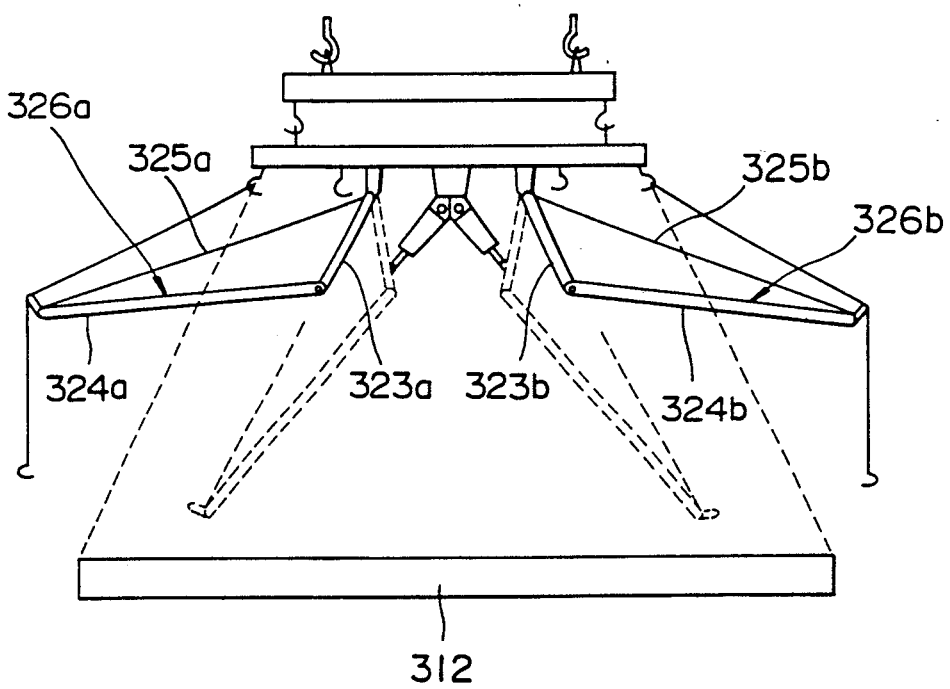
FIG. 15 is a schematic front elevational view of a modification of the lifting sling illustrated in FIG. 9.

Referring to FIG. 15, there is shown a modification of the lifting sling illustrated in FIG. 9. The modification shown in FIG. 15 comprises a pair of guide arm units 326*a* and 326*b* which comprise a pair of protopodite joint arms 323*a* and 323*b*, a pair of follower joint arms 324*a* and 324*b* and a pair of extension wires 325*a* and 325*b*, respectively. In the modification, the guide arm units 326*a* and 326*b* are used to lift up the elongated article 312.

The modification illustrated in FIG. 15 has the following advantages. That is, the guide arm units 326*a* and 326*b* are functionally wide in operational range. Further, the protopodite joint arms 323*a* and 323*b*, the follower joint arms 324*a* and 324*b*, the extension wires 325*a* and 325*b* and so on can be replaced with ones having any suitable lengths, whereby the lifting sling can be applied to transportation of pipes having various longitudinal lengths.

Figure 16:
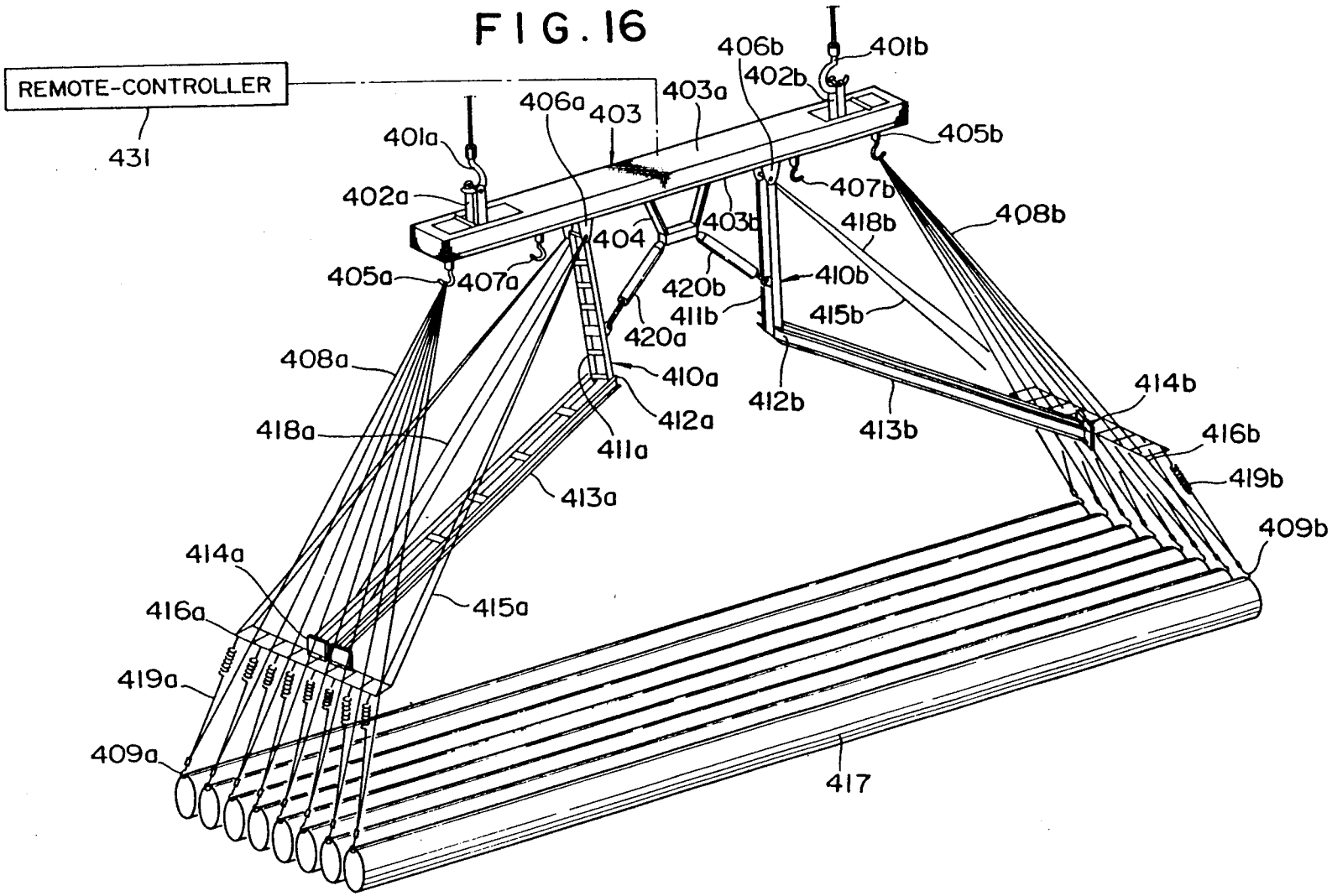
FIG. 16 is a schematic perspective view of a lifting sling for a plurality of elongated articles to be carried, according to a fourth embodiment of the invention.

Referring next to FIG. 16, there is shown a lifting sling for at least one elongated article to be carried, according to a fourth embodiment of the invention. The lifting sling is used to lift up at least one elongated article 417, that is, eight pipes. An elongated horizontal lifting beam 403 is hung from a pair of crane hooks 401*a* and 401*b* through respective hoisting elements 402*a* and 402*b* which are fixedly mounted on an upper surface 403*a* of the elongated beam 403. A bearing element 404 for a pair of actuators 420*a* and 420*b* is fixedly mounted on a center of a lower surface 403*b* of the elongated beam 403. A pair of hooks 405*a* and 405*b* for respective wire rope units 408*a* and 408*b* are fixedly mounted on the respective ends of the lower surface 403*b* of the elongated beam 403. A pair of bearing elements 406*a* and mounted on the elongated beam 403 at a location between the crane hooks 405*a* and 405*b*, and centering about the bearing element 404. Further, a pair of hooks 407*a* and 407*b* for the respective wire rope units 408*a* and 408*b* are provided as occasion demands. The hooks 407*a* and 407*b* are used to carry short pipes, and so on.

At each of the lower ends of the pair of wire rope units 408*a* and 408*b*, one of a pair of U-shaped hook units 409*a* and 409*b* is provided. The pair of wire rope units 408*a* and 408*b* detachably are hung from the respective hooks 405*a* and 405*b*. Each of the pair of wire rope units 408*a* and 408*b* is composed of eight wire ropes. Moreover, the respective bodies of the guide arm units 410*a* and 410*b* are composed of a pair of protopodite arms 411*a* and 411*b* and a pair of follower joint arms 413*a* and 413*b* which are pivotally connected respectively to the protopodite arms 411*a* and 411*b* through respective joints 412*a* and 412*b*. At the lower ends of the follower joint arms 413*a* and 413*b*, a pair of abutments 414*a* and 414*b* in the form of abutment plates are provided respectively.

A pair of frame guide units 416*a* and 416*b* pivotally depend respectively from the pair of bearing elements 406*a* and 406*b* through respective slinging wire units 415*a* and 415*b*. The frame guide units 416*a* and 416*b* serve to slidably guide the wire rope units 408*a* and 408*b*.

FIG. 16 shows a condition in which the abutments 414*a* and 414*b* at the respective lower ends of the guide arm units 410*a* and 410*b* push the frame guide units 416*a* and 416*b*, respectively. The condition illustrated in FIG. 16 is just before the U-shaped hook units 409*a* and 409*b* are disengaged from the elongated articles 417.

A pair of wire units 418*a* and 418*b* extend respectively between base ends of the protopodite arms 411*a* and 411*b* and the lower ends of the follower joint arms 413*a* and 413*b*. The wire units 418*a* and 418*b* serve to restrict joint opening angles of the respective guide arm units 410*a* and 410*b*. Specifically, maximum joint opening angles of the respective guide arm units 410*a* and 410*b* are determined respectively by lengths of the wire units 418*a* and 418*b*.

That is, the wire units 418*a* and 418*b* have respective lengths which are suitably determined in accordance with the lengths of the elongated articles 417 or pipes that are the subjects of transportation. In addition, since the size range, in which the respective guide arm units 410*a* and 410*b* can be used, is restricted due to lift of the elongated articles 417, it is needless to say that, as occasion demands, guide arm units 410*a* and 410*b* which are most suitable in size are used.

In the fourth embodiment illustrated in FIG. 16, as the guide arm units 410*a* and 410*b*, a joint type is employed which is composed of the pair of protopodite arms 411*a* and 411*b* and the pair of follower joint arms 413*a* and 413*b*. As the guide arm units 410*a* and 410*b*, however, a pair of guide arm units may be used which are integral bodies having no in design, because the joint type is light in weight and can be used for elongated articles having longer size.

A pair of spring units 419*a* and 419*b* extend respectively between the frame guide units 416*a* and 416*b* and the lower ends of the respective wire rope units 408*a* and 408*b*, that is, the U-shaped hook units 409*a* and 409*b* in this embodiment. The spring units 419*a* and 419*b* serve to prevent the ropes of the wire rope units 408*a* and 408*b* from slipping off from the respective frame guide units 416*a* and 416*b*.

The pair of actuators 420*a* and 420*b* each have one of their ends pivotally attached to the bearing element 404. The other ends of the respective actuators 420*a* and 420*b* are pivotally connected respectively to the protopodite arms 411*a* and 411*b* of the guide arm units 410*a* and 410*b*. As the actuators 420*a* and 420*b*, well-known cylinders may be used such as pneumatic, hydraulic or electric cylinders. A remote-controller 431 is connected to the actuators 420*a* and 420*b* to control the same. An operational source and piping of the actuators 420*a* and 420*b* are known well, and a detailed description of such operational source and piping will be omitted to avoid duplication.

In the fourth embodiment, the capacity of the actuators 420*a* and 420*b* is not required to support the weight of the elongated articles 417 and it will suffice if the actuators 420*a* and 420*b* can withstand operation of the guide arm units 410*a* and 410*b* and the wire rope units 408*a* and 408*b*. Accordingly, it is possible to use actuators 420*a* and 420*b* which are compact in size.

Although each of the frame guide units 416*a* and 416*b* comprises a plurality of windows and each of the wire rope units 408*a* and 408*b* comprises a plurality of wire ropes, it is possible for a single window and a single wire rope to arrange at each of the ends of the elongated beam 403.

Figure 17:
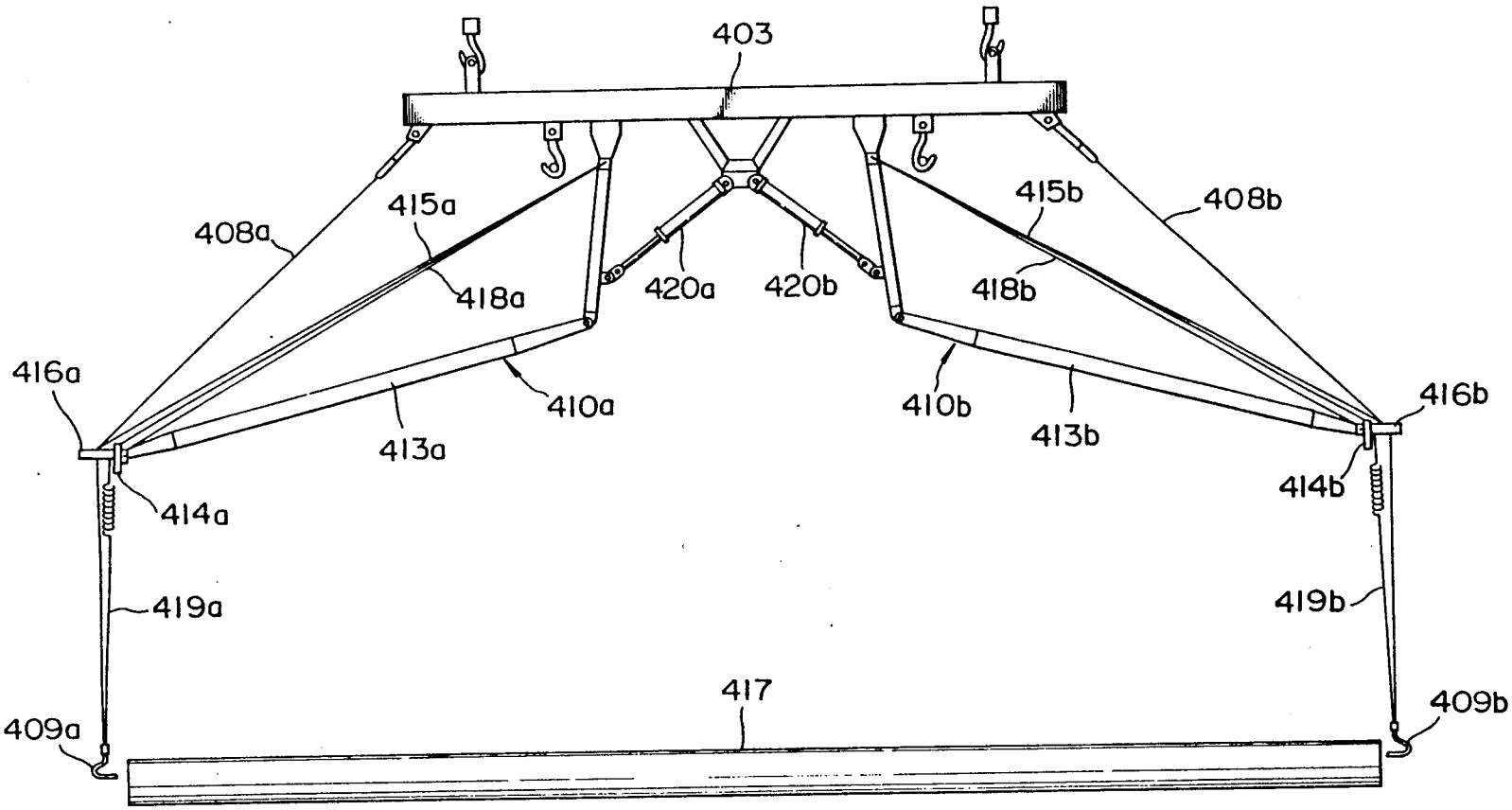
FIG. 17 is a view for explanation of an operational condition of the lifting sling illustrated in FIG. 16, showing a pair of actuators whose respective rods are extended.

FIG. 17 shows a condition in which the actuators 420*a* and 420*b* are operated to extend their respective rods, and the abutments 414*a* and 414*b* at the lower ends of the respective guide arm units 410*a* and 410*b* are urged respectively against the pair of frame guide units 416*a* and 416*b* to guide the wire rope units 408*a* and 408*b*. The condition illustrated in FIG. 17 is just before the U-shaped hook units 409*a* and 409*b* are hung on the elongated articles 417 or just after the U-shaped hook units 409*a* and 409*b* have been disconnected from the elongated articles 417. In the fourth embodiment, an operation, in which the U-shaped hook units 409*a* and 409*b* are hung on the elongated articles 417, is done manually. This is because an installation, in which the pipe hanging operation is done completely automatically, is complicated and is cumbersome and troublesome particularly when a plurality of pipes are simultaneously delivered. Accordingly, the gist of the fourth embodiment is such that the pipe hanging operation is only automatized so as to simplify an installation and operation and to make them practical.

Specifically, in the aforesaid pipe hanging operation, tensions of the respective spring units 419*a* and 419*b* act upon the respective hook units 409*a* and 409*b*. Thus, it is possible to carry the pipe hanging operation into effect easily, safely and reliably.

Figure 18:
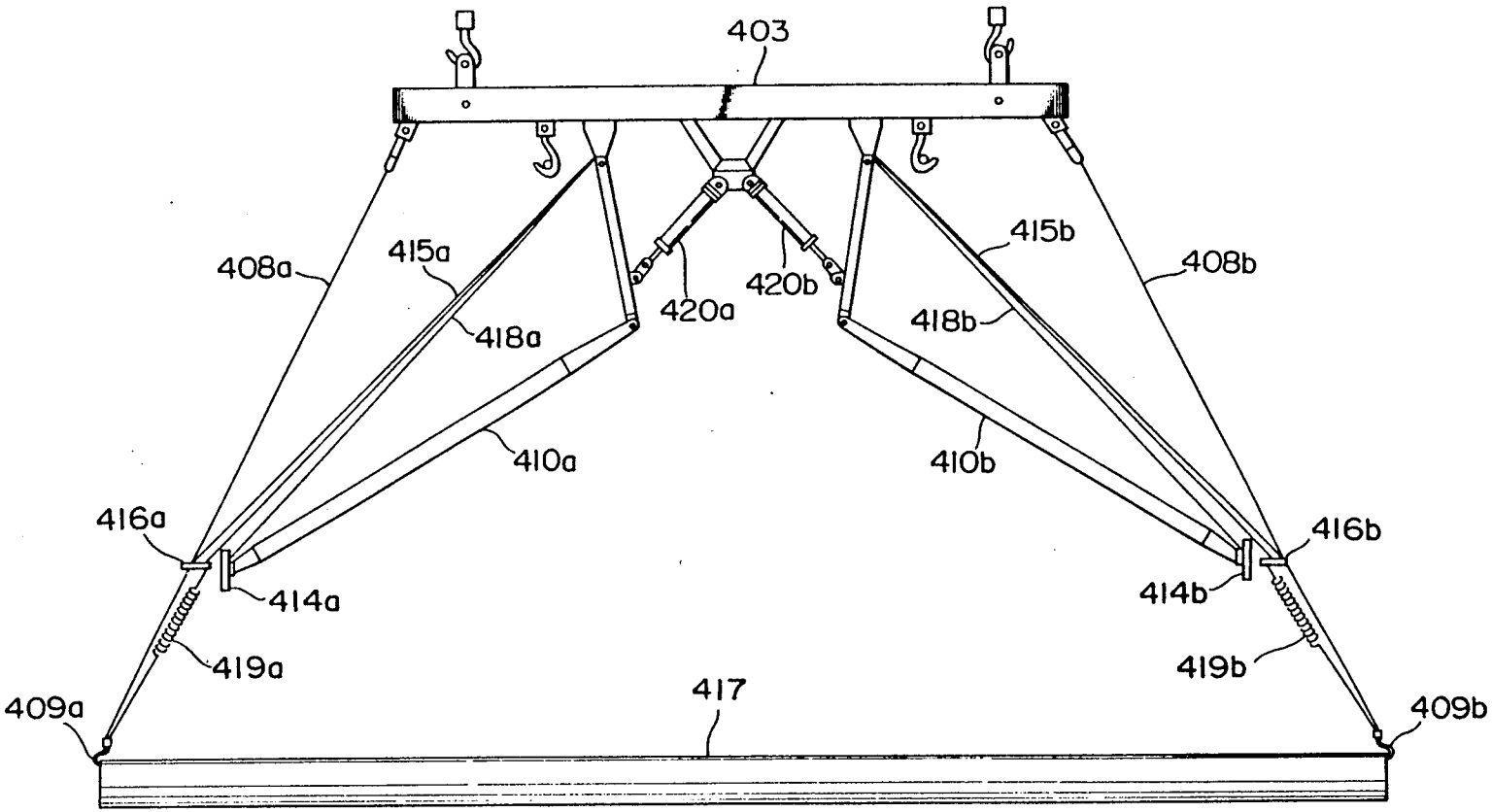
FIG. 18 is a view similar to FIG. 17, but showing the pair of actuators whose respective rods are retracted.

FIG. 18 shows a condition in which the actuators 420*a* and 420*b* are operated to retract their rods, and the abutments 414*a* and 414*b* at the lower ends of the guide arm units 410*a* and 410*b* are moved away from the frame guide units 416*a* and 416*b*, to lift up the elongated articles 417 through the wire rope units 408*a* and 408*b*. Since the tensions of the respective spring units 419*a* and 419*b* act upon the U-shaped hook units 409*a* and 409*b*, there is entirely no fear that the U-shaped hook units 409*a* and 409*b* will slip off from the elongated articles 417.

Figure 19:
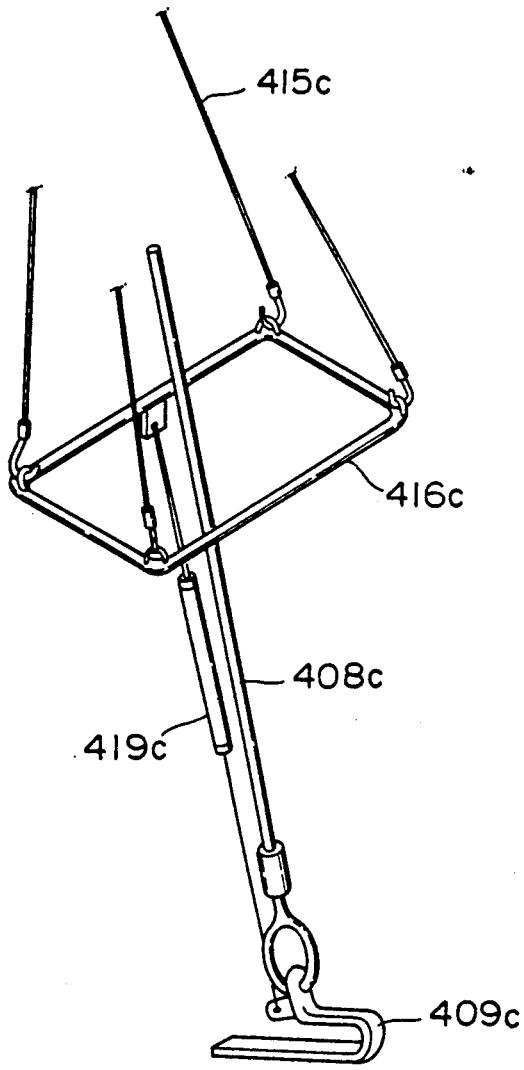
FIG. 19 is a perspective view of one of a pair of guide ropes which can be used in the lifting sling illustrated in FIG. 16.
Figure 20:
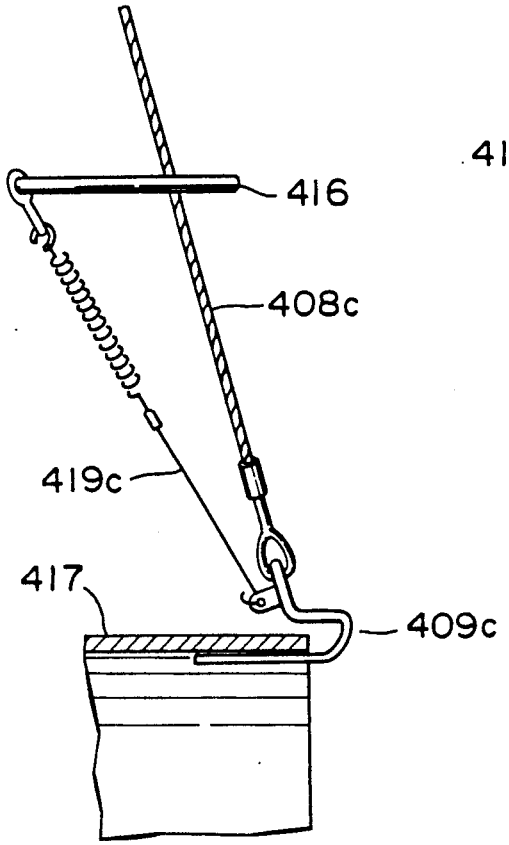
FIG. 20 is a cross-sectional view of the guide rope illustrated in FIG. 19.

FIGS. 19 and 20 are a schematic perspective view and a cross-sectional view, respectively, of one of a pair of guide rope units which can be used in the lifting sling illustrated in FIG. 16. FIGS. 19 and 20 show a mutual relationship between a frame guide 416*c* having a single window, a single wire rope 408*c*, a single U-shaped hook 409*c* and a single spring element 419*c*.

Figure 21:
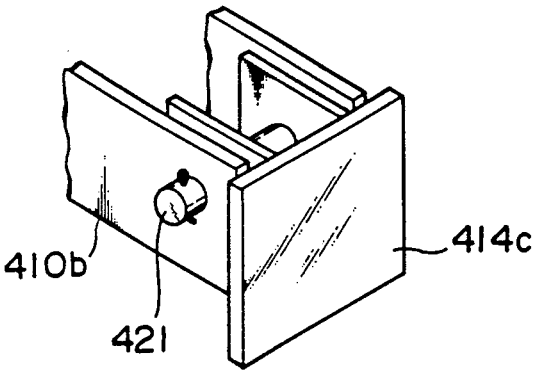
FIG. 21 is a schematic fragmentary perspective view of one of a pair of abutments which can be utilized in the lifting sling illustrated in FIG. 16.

FIG. 21 is a perspective view of one of a pair of abutments 414*c* which can be used in the lifting sling illustrated in FIG. 16. The abutment 414*c* is mounted on the forward end of the guide arm unit 410*b*. The abutment 414*c* is movable angularly about an axis of a pin 421 within a set range. The abutment 414*c* may be in the form of a plate or a lattice. That is, the material for the abutment 414*c*, can be a suitable material such as plastics, rubber or the like, and is not limited to metal, provided that the abutment 414*c* has a size and dimension required for being abutted against the frame guide unit (416*a* or 416*b* illustrated in FIG. 16) which has adequate mechanical strength. Further, the abutment 414*c* can use for its construction material such as a round pipe, which is effective in wear prevention. Moreover, a part of the abutment 414*c* may be resilient or elastic. It is possible to design the abutment 414*c* adequate for the conditions of operation.

The aforesaid frame guide units (416*a* and 416*b* illustrated in FIG. 16) may have constructions which are also resilient or elastic.

Figure 22:
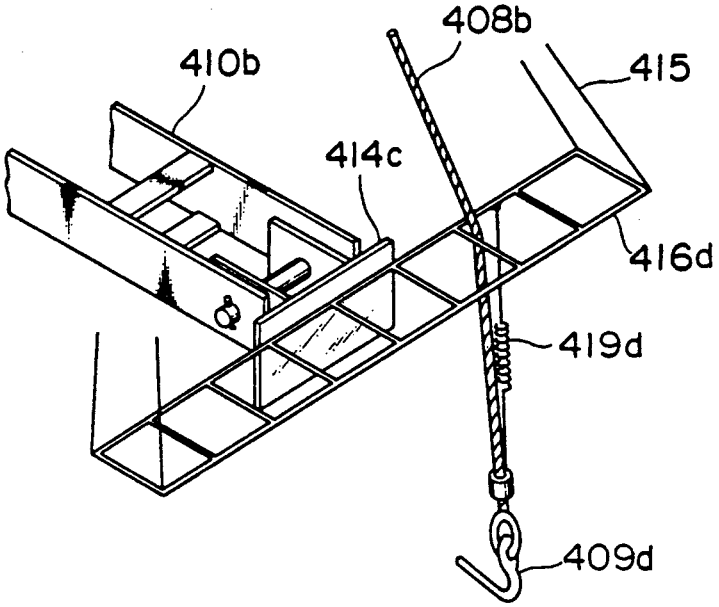
FIG. 22 is a schematic perspective view of one of a pair of guide arm units which can be used in the lifting sling illustrated in FIG. 16.

FIG. 22 shows another specific example of the pair of frame guide units 416*a* and 416*b* illustrated in FIG. 16. According to the specific example, a frame guide unit 416*d* has eight windows. Thus, the frame guide unit 416*d* can be used for eight elongated articles to be carried, that is, pipes. In this manner, by the use of the frame guide unit 416*d* having an adequate number of windows, it is possible to carry the slinging work into effect quickly and optimally in accordance with conditions of the elongated articles. In this connection, a simple rod-like element, on which the wire rope unit 408*b* having a plurality of wire ropes rests, may merely be used in substitution for the frame guide unit 416*d*.

Figure 23:
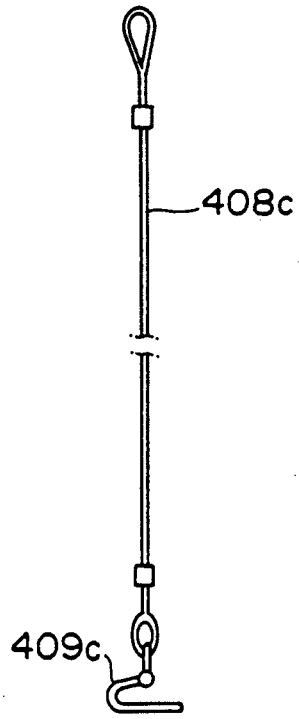
FIG. 23 is a front elevational view of the wire rope unit illustrated in FIGS. 19 and 20.

FIG. 23 shows, in detail, the wire rope 408*c* illustrated in FIGS. 19 and 20. It is needless to say that each of the wire rope units 408*a* and 408*b* illustrated in FIG. 16 includes adequate numbers of wire ropes. Further, as occasion demands, adequate coating may be applied to the wire ropes in order to prevent wear from occurring.

Figure 24:
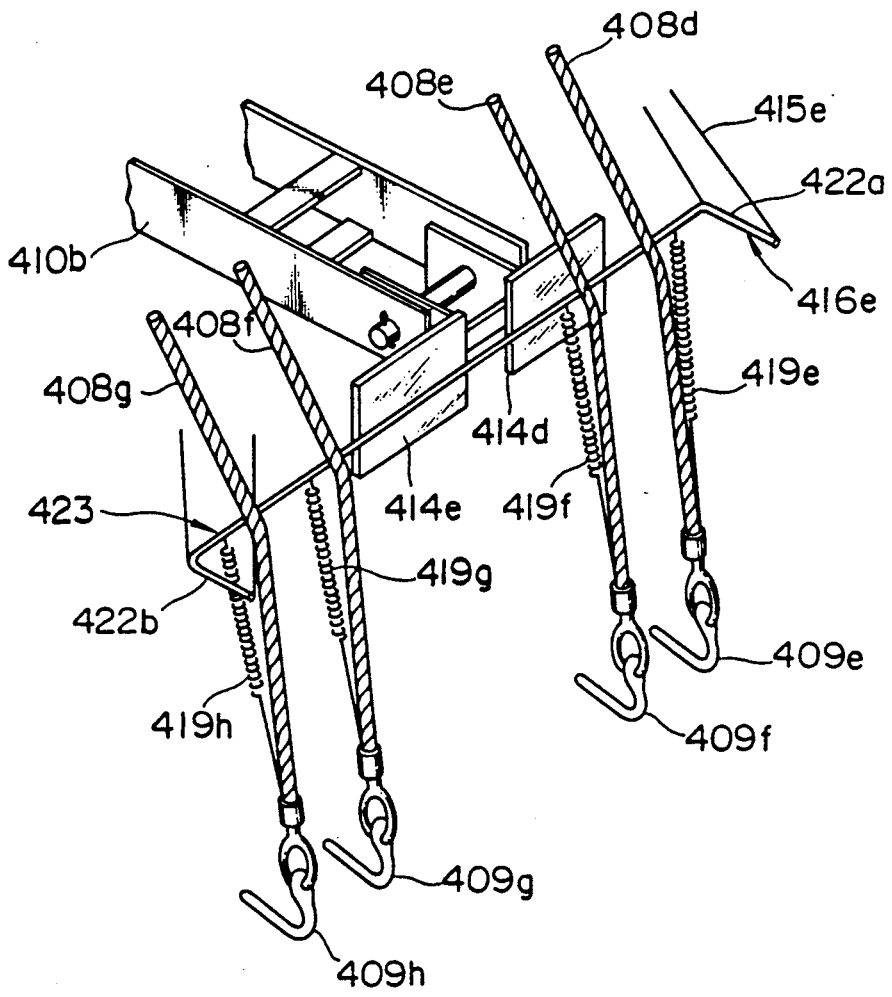
FIG. 24 is a schematic perspective view of another example of frame guide units which can be used in the lifting sling illustrated in FIG. 16.
Figure 26:
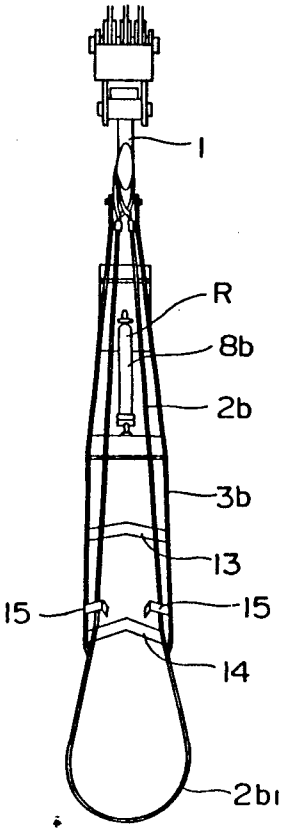
FIG. 26 (PRIOR ART)
FIG. 26 is a side elevational view of the lifting sling illustrated in FIG. 25.
Figure 25:
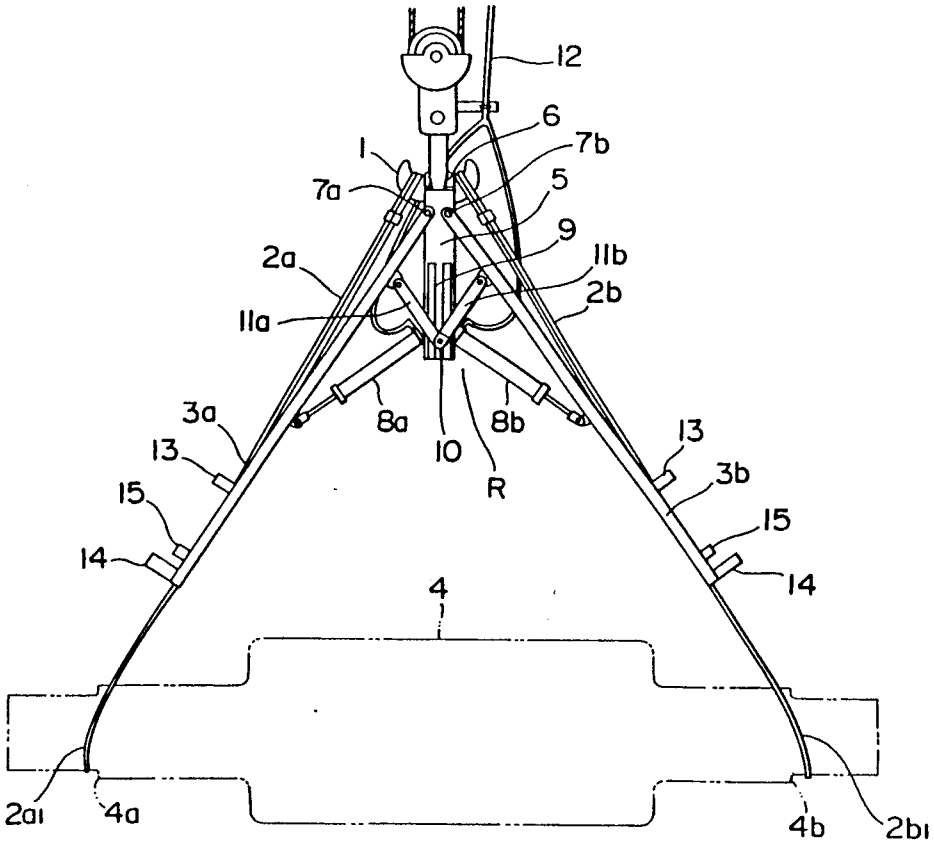
FIG. 25 (PRIOR ART)
FIG. 25 is a schematic front elevational view of a conventional lifting sling.

FIG. 24 is a schematic perspective view of another specific example of the frame guide units 416*a* and 416*b* illustrated in FIG. 16. A frame guide 416*e* according to another specific example is formed from a rod-like element 423 which is provided at it ends with a pair of hooks 422*a* and 422*b* for preventing a plurality of wire ropes 408*d* through 408*g* from slipping off from the frame guide 416*e*. As will be apparent from FIG. 24, the wire ropes 408*d* through 408*g* are vertically guided by the rod-like element 423, while sliding on the same. The rod-like element 423 is urged or pushed by a pair of abutments 414*d* and 414*e* in the form of plates, which are provided at the lower end of the guide arm unit 410*b*.

The hooks 422*a* and 422*b* act such that the wire ropes 408*d* through 408*g* do not slip off from the rod-like element 423. Further, since a plurality of, four in this specific example, spring elements 419*e* through 419*h* extend between the guide unit 416*e* and a plurality of U-shaped hooks 409*e* through 409*h* which are mounted respectively to the lower ends of the wire ropes 408*e* through 408*g*, there is no fear that the U-shaped hooks 409*e* through 409*h* will slip off from the elongated articles when the latter are lifted up.

As described above, the frame guide unit 416*e* guides the wire ropes 408*d* through 408*g* so as not to slip off from the frame guide unit 416*e*. Further, the frame guide unit 416*e* acts to ensure that the U-shaped hooks 409*e* through 409*h* are hung on the elongated articles through the spring elements 419*e* through 419*h*. As long as the frame guide unit 416*e* functions as described above, it is possible to adequately design the frame guide unit 416e to any suitable form.

What is claimed is:

1. A lifting sling for lifting up at least one elongated article, said lifting sling comprising:

an elongated beam;

hoisting means for a hook unit of a crane, said hoisting means being attached to a top of said elongated beam;

a pair of hooking means arranged respectively at both ends of said elongated beam;

a pair of wire rope means depending respectively from said pair of hooking means;

a pair of guide arm means each having one end directly and pivotally attached to one of the ends of said elongated beam, said pair of guide arm means slidably accommodating and supporting respectively said pair of wire rope means substantially from said respective ends pivotally attached to the elongated beam to the respective ends of said guide arm means opposite from the ends thereof pivotally attached to the elongated beam;

a pair of actuator means each having one end pivotally attached to said elongated beam, the other end of each of the actuator means being pivotally attached to said corresponding guide arm means, said pair of actuator means being capable of moving respectively said pair of guide arm means toward and away from each other about said respective ends of the guide arm means; and control means connected to said pair of actuator means for operating the same to move said pair of guide arm means toward and away from each other.

2. A lifting sling according to claim 1, wherein said pair of guide arm means are movable toward and away from each other respectively by said pair of actuator means in a plane including said elongated beam.

3. A lifting sling according to claim 1, wherein said pair of wire rope means are pivotally attached to said elongated beams, wherein each of said pair of guide arm means includes a pair of guide arm sections, and wherein said lifting sling further includes a pair of support beams for supporting respectively said pair of guide arm units such that an opening angle between the pair of guide arm units is adjustable, said pair of support beams each having one end which is pivotally connected respectively to the end of said elongated beam, said pair of support beams being arranged respectively between said pair of actuator means and said pair of guide arm means for supporting the same, the other ends of the respective actuator means being pivotally connected respectively to said pair of support beams, and a pair of guide actuator means mounted respectively to said support beams, each of said pair of guide actuator means being connected to the pair of guide arm sections of a corresponding one of said pair of guide arm means, for moving the pair of guide arm sections toward and away from each other in a plane perpendicular to a plane in which said pair of guide arm means are moved toward and away from each other.

4. A lifting sling according to claim 1, wherein said pair of hooking means are detachable with respect the respective ends of said elongated beam.

5. A lifting sling according to claim 1, wherein each of said pair of wire rope means includes at least one pair of wire rope sections, and wherein said lifting sling further includes at least two pairs of detachable joint elements which are arranged respectively at lower ends of the respective pairs of wire rope sections, and at least one pair of replaceable abutments connected respectively between the pairs of joint elements.

6. A lifting sling according to claim 5, wherein said pair of abutments are formed by a pair of chains.

7. A lifting sling according to claim 1, wherein each of said pair of wire rope means includes at least one pair of wire rope sections, and wherein said lifting sling further includes at least one pair of abutment means having respective end abutments which are engageable respectively with both ends of the elongated article.

8. A lifting sling according to claim 1, wherein each of said pair of wire rope means includes at least one wire rope.

9. A lifting sling according to claim 1, wherein each of said pair of wire rope means includes a plurality of wire ropes.

10. A lifting sling according to claim 1, wherein each of said pair of guide arm means includes at least one guide arm.

11. A lifting sling according to claim 1, wherein each of said pair of guide arm means includes a plurality of guide arms.

12. A lifting sling according to claim 1, wherein said pair of actuator means are composed of a pair of operational cylinders.

13. A lifting sling according to claim 1, wherein said elongated beam is made of a rigid body.

14. A lifting sling according to claim 1, wherein said hoisting means includes a single hoisting element arranged at a center of the top of said elongated article.

15. A lifting sling according to claim 1, wherein said hoisting means includes a pair of hoisting elements which are arranged respectively adjacent to both ends of said elongated article.

16. A lifting sling according to claim 1, wherein the respective ends of the respective actuator means are mounted on a bottom of said elongated beam.

17. A lifting sling according to claim 1, wherein said control means includes a remote-controller.

18. A lifting sling according to claim 1, further including center bearing means arranged at a center of a lower surface of said elongated beam, said pair of actuator means being mounted on said elongated beam through said center bearing means, a pair of bearing means mounted on said elongated beam at respective locations between said pair of hooking means and said center bearing means, one end of each of the respective guide arm means being attached to said elongated beam through said pair of bearing means, a pair of U-shaped hook means arranged respectively at forward ends of the respective wire rope means, for engagement with opposite ends of the elongated article, a pair of guide means fixedly mounted respectively to forward ends of said pair of guide arm means, for guiding respectively said pair of wire rope means, and a pair of spring means extending respectively between said pair of guide means and said pair of U-shaped hook means, for preventing said U-shaped hook means from being disengaged from the opposite ends of said elongated article.

19. A lifting sling according to claim 18, wherein said pair of wire rope means are detachably mounted respectively to said pair of hooking means.

20. A lifting sling according to claim 18, wherein each of said pair of guide means is in the form of a rod.

21. A lifting sling according to claim 18, wherein each of said pair of wire rope means includes a plurality of wire ropes, wherein each of said pair of guide means is formed into a frame configuration for guiding said wire ropes individually, and wherein each of said spring means includes a plurality of spring elements which are arranged in side-by-side relation to each other and which are associated respectively with the wire ropes of a corresponding one of said pair of wire rope means.

22. A lifting sling according to claim 21, wherein each of said guide means has at least a part which is made of deformable elastic material.

23. A lifting sling according to claim 18, wherein each of said pair of guide means has at least a part which is made of deformable elastic material.

24. A lifting sling according to claim 18, wherein said U-shaped hook means includes at least one U-shaped hook.

25. A lifting sling according to claim 18, wherein said U-shaped hook means includes a plurality of U-shaped hooks.

26. A lifting sling according to claim 18, wherein said spring means includes at least one spring element.

27. A lifting sling according to claim 18, wherein said spring means includes a plurality of spring elements.

28. A lifting sling according to claim 1, further including center bearing means arranged at a center of a lower surface of said elongated beam, said pair of actuator means being attached on said elongated beam through said center bearing means, a pair of bearing means mounted on said elongated beam at respective locations between said pair of hooking means and said center bearing means, the end of each of the respective guide arm means being mounted on said elongated beam through the corresponding bearing means, a pair of U-shaped hook means arranged respectively at forward ends of the respective wire rope means, for engagement with both ends of the elongated article, a pair of guide means fixedly mounted respectively to forward ends of said pair of guide arm means, for guiding respectively said pair of wire rope means, a pair of abutments arranged respectively at the forward ends of the respective guide arm means, said pair of guide arm means pivotally guiding respectively said pair of guide means by way of said pair of abutments, a pair of spring means extending respectively between said pair of guide means and said pair of U-shaped hook means, for preventing said U-shaped hook means from being disengaged respectively from the opposite ends of said elongated article, and a pair of hanging rope means having ends which are attached to said elongated beam, said pair of guide means being attached respectively to the other ends of said pair of hanging rope means.

29. A lifting sling according to claim 28, wherein said pair of wire rope means are detachably attached respectively to said pair of hook means.

30. A lifting sling according to claim 28, wherein each of said pair of guide means is in the form of a rod.

31. A lifting sling according to claim 28, wherein each of said pair of wire rope means includes a plurality of wire ropes, wherein each of said pair of guide means is formed into a frame configuration for guiding said wire ropes individually, and wherein each of said spring means includes a plurality of spring elements which are arranged in side-by-side relation to each other and which are associated respectively with the wire ropes of the corresponding wire rope means.

32. A lifting sling according to claim 31, wherein each of said guide means has at least a part which is made of deformable elastic material.

33. A lifting sling according to claim 28, wherein each of said pair of guide means has at least a part which is made of deformable elastic material.

34. A lifting sling according to claim 28, wherein each of said pair of U-shaped hook means includes at least one U-shaped hook.

35. A lifting sling according to claim 28, wherein each of said pair of U-shaped hook means includes a plurality of U-shaped hooks.

36. A lifting sling according to claim 28, wherein each of said pair of spring means includes at least one spring element.

37. A lifting sling according to claim 28, wherein each of said pair of spring means includes a plurality of spring elements.

38. A lifting sling according to claim 28, wherein each of pair of said guide arm means includes a protopodite arm having one end which is pivotally attached to a corresponding one of said bearing means, a follower arm, a joint through which said protopodite arm is pivotally connected to said follower arm, and wire means extending between the end of said protopodite arm and the other end of said follower means.

39. A lifting sling according to claim 1, wherein said elongated beam is arranged horizontally.

40. A lifting sling as described in claim 39 wherein said elongated beam is a rigid body, the actuator means being pivotally attached, respectively, to the rigid body nearer the center thereof than the respective guide arm means.

41. A lifting sling for lifting up at least one elongated article, said lifting sling comprising:

an elongated beam;

hoisting means for a hook unit of a crane, said hoisting means being attached to a top of said elongated beam;

a pair of hooking means arranged respectively at both ends of said elongated beam, said pair of hooking means including at least one pair of pivots;

a pair of wire rope means depending respectively from said pair of hooking means;

a pair of guide arm means each having one end pivotally attached to an end portion of said elongated beam, said pair of guide arm means accommodating and supporting respectively said pair of wire rope means, said pair of guide arm means having respective center axes of pivotal movement, said center axes of pivotal movement of the respective guide arm means being the same as the respective axes of said pivots, a pair of actuator means each having one end pivotally attached to said elongated beam, the other end of each of the actuator means being pivotally attached to said corresponding guide arm means, said pair of actuator means being capable of moving respectively said pair of guide arm means toward and away from each other about said respective ends of the guide arm means; and control means connected to said pair of actuator means for operating the same to move said pair of guide arm means toward and away from each other.

* * * * *